US009167941B2

(12) United States Patent
Cittadino et al.

(10) Patent No.: US 9,167,941 B2
(45) Date of Patent: Oct. 27, 2015

(54) SHEET PRODUCT DISPENSER WITH AUXILIARY FEED BUTTON

(75) Inventors: Antonio M. Cittadino, Appleton, WI (US); Ronald Richard Reeb, De Pere, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 189 days.

(21) Appl. No.: 13/240,645

(22) Filed: Sep. 22, 2011

(65) Prior Publication Data

US 2013/0079923 A1 Mar. 28, 2013

(51) Int. Cl.
*G07F 17/00* (2006.01)
*A47K 10/36* (2006.01)

(52) U.S. Cl.
CPC ..... *A47K 10/36* (2013.01)

(58) Field of Classification Search
CPC ..... A47K 10/3625; A47K 10/26
USPC ..... 700/240, 231, 232, 243
See application file for complete search history.

(56) References Cited

U.S. PATENT DOCUMENTS

| | | | | |
|---|---|---|---|---|
| 3,831,933 | A * | 8/1974 | Fantozzi | 271/258.01 |
| 5,452,832 | A * | 9/1995 | Niada | 225/11 |
| 5,908,137 | A * | 6/1999 | Pattarozzi | 221/45 |
| 6,412,655 | B1 * | 7/2002 | Stuetzel et al. | 221/13 |
| 6,903,654 | B2 | 6/2005 | Hansen et al. | |
| 7,040,566 | B1 | 5/2006 | Rodrian et al. | |
| 7,044,421 | B1 * | 5/2006 | Omdoll et al. | 242/564.4 |
| 7,296,765 | B2 | 11/2007 | Rodrian | |
| 7,984,872 | B2 * | 7/2011 | Kuehneman et al. | 242/563.2 |
| 2001/0001475 | A1 * | 5/2001 | Formon et al. | 242/563.2 |

(Continued)

FOREIGN PATENT DOCUMENTS

| | | | |
|---|---|---|---|
| EP | 1405590 | A1 | 4/2004 |
| WO | 03051166 | A1 | 6/2003 |

OTHER PUBLICATIONS

"Harwound Roll Towel Dipensers"; http://www.vondrehle.com/default/index.cfm/product-catalog/dispensers/hardwound-towel . . . ; Copyright 2011 von Drehle Corporation; retrieved Nov. 3, 2011; 4 pgs.

(Continued)

*Primary Examiner* — Michael K Collins
(74) *Attorney, Agent, or Firm* — Sutherland Asbill & Brennan LLP

(57) ABSTRACT

A sheet product dispenser includes a housing having a front cover, a main controller, a motor, a dispensing mechanism, a maintenance switch, and an auxiliary feed push button. The motor, main controller and dispensing mechanism are configured to dispense a length of sheet product in response to a signal representative of a request for sheet product. The maintenance switch is internally disposed within the housing and accessible for actuation when the front cover is open, in operable communication with the main controller to facilitate operation of the motor when actuated. The auxiliary feed push button is disposed in operable communication with the maintenance switch, and is disposed to be accessible and actuatable when the cover is closed. The main controller is responsive to executable instructions to facilitate actuation of the motor in response to a signal from the maintenance switch when actuated by the auxiliary feed push button.

20 Claims, 14 Drawing Sheets

(56) References Cited

U.S. PATENT DOCUMENTS

| | | | | |
|---|---|---|---|---|
| 2008/0128446 | A1* | 6/2008 | Kuehneman et al. | 221/10 |
| 2008/0190982 | A1* | 8/2008 | Omdoll | 225/14 |
| 2010/0089939 | A1* | 4/2010 | Morris et al. | 221/1 |
| 2010/0286817 | A1* | 11/2010 | Goeking et al. | 700/231 |
| 2010/0286818 | A1* | 11/2010 | Goeking et al. | 700/232 |
| 2011/0168831 | A1* | 7/2011 | Mok et al. | 242/564.4 |
| 2011/0253829 | A1* | 10/2011 | Goeking et al. | 242/560.1 |
| 2012/0097699 | A1* | 4/2012 | Formon et al. | 221/199 |

OTHER PUBLICATIONS

PCT Search Report and Written Opinion for International Application No. PCT/US2011/052753; International Filing Date: Sep. 22, 2011; Date of Mailing: Apr. 19, 2012; 9 pgs.

Kimberly-Clark Professional; Electronic Touchless Coreless JRT Dispenser; Product Code: 09619; Buildings Editor's Choice Top Products 2008; 1 pg.

* cited by examiner

SHEET PRODUCT DISPENSER WITH AUXILIARY FEED BUTTON

BACKGROUND OF THE INVENTION

The present invention relates generally to a sheet product dispenser, and in particular to a sheet product dispenser having a primary feed sensor and an auxiliary feed button for permitting an operator to dispense sheet product by an auxiliary means.

Sheet product dispensers typically include rolls of sheet product. The sheet product is dispensed from the roll by passing one end of the sheet product through a pair of rollers. With electrically operated dispensers, one of the rollers is coupled to an electric motor that is selectively energized by a controller. Friction between the rollers and the sheet product pulls the sheet product from the sheet product roll when the motor is operated. Some type of separation arrangement is also provided for allowing a portion of the sheet product roll to be removed from the dispenser by a user.

The separation arrangement may be provided in several ways. The sheet product may include perforations for example. When sheet product with perforations is used, the dispenser includes a means for positioning the perforations adjacent to the opening where the sheet product is dispensed. The perforations allow the sheet product dispensed to the user to separate when the user pulls on the sheet product.

Alternatively, or in conjunction with the perforations, the dispenser may also have a cutting arrangement. In this arrangement, a cutting device, commonly referred to as a tear bar, is positioned adjacent the opening where the sheet product is dispensed. The tear bar may be a sharp blade or a serrated blade. The tear bar is positioned such that when the user pulls on the dispensed sheet product, the sheet product engages the tear bar. This action results in the sheet product being cut or torn allowing the user to remove the dispensed portion. When a dispensed sheet product is torn from the dispenser by a user, such an action is called a "tear".

Generally, the sheet product dispenser includes a controller for performing and controlling the functional operations of the dispenser. The dispenser may control the amount of sheet product dispensed in several ways. One means of controlling the amount of dispensed sheet product is by timing the operation of the motor coupled to the rollers.

While existing sheet product dispensers are suitable for their intended purposes, there still remains a need for improvements particularly regarding the detection of when the dispensed sheet product has been separated from the dispenser, and to provide for further dispensing of sheet product if a tear of the dispensed sheet product is not detected. Further, there is also a need for improvements that minimize waste while providing consistent dispensing of sheet product for an end user.

SUMMARY OF THE INVENTION

An embodiment includes a sheet product dispenser having a housing with a front cover, a main controller, a motor, a dispensing mechanism, a maintenance switch, and an auxiliary feed push button. The main controller is disposed within the housing. The motor is disposed within the housing in operable communication with the main controller. The dispensing mechanism is disposed within the housing in operable communication with the motor, wherein the main controller, the motor and the dispensing mechanism are configured to dispense a length of sheet product in response to a signal representative of a request for sheet product. The maintenance switch is internally disposed within the housing and accessible for actuation by a user when the front cover is open, and is disposed in operable communication with the main controller to facilitate operation of the motor when actuated. The auxiliary feed push button is disposed in operable communication with the maintenance switch, and is so disposed as to be accessible and actuatable by a user when the cover is closed. The main controller is responsive to executable instructions to facilitate actuation of the motor and the dispensing mechanism in response to a signal from the maintenance switch when actuated by the auxiliary feed push button to dispense a length of sheet product.

An embodiment includes a sheet product dispenser having a housing with a cover. A main controller, a motor, and a dispensing mechanism are all disposed within the housing in operable communication with each other to dispense a length of sheet product. A stationary tear bar is operably disposed proximate the dispensing mechanism to facilitate separation of the sheet product, a movable tear bail is operably disposed proximate the tear bar, and a tear sensor is operably disposed to actuate upon movement of the tear bail. An auxiliary feed push button is disposed in operable communication with a switch, the switch being so disposed as to be accessible and actuatable by a user when the cover is open, the push button being so disposed as to be accessible and actuatable by a user when the cover is closed. The main controller is responsive to executable instructions to facilitate actuation of the motor and the dispensing mechanism to dispense a length of sheet product in response to a signal from the tear sensor that is responsive to movement of the tear bail. The main controller is responsive to executable instructions to facilitate actuation of the motor and the dispensing mechanism to dispense a length of sheet product in response to a signal from the switch when actuated by the auxiliary feed push button.

An embodiment includes a method of operating a sheet product dispenser. A motor and a dispensing mechanism are activated to facilitate dispensing of a length of sheet product from the dispenser. The dispensed sheet product is positioned to enable separation of the sheet product from a housing of the dispenser via a stationary tear bar, wherein a movable tear bail is disposed proximate the tear bar and is in signal communication with a tear sensor. The motor is deactivated via a signal from the tear sensor, the signal being representative of the tear bail having moved from a home position to an actuated position and back to the home position. In an event where the signal is representative of the tear bail having moved from a home position to an actuated position but is not representative of the tear bail having moved back to the home position, the motor is activated via an auxiliary feed push button.

BRIEF DESCRIPTION OF THE DRAWINGS

Referring now to the drawings, which are meant to be exemplary and not limiting, and wherein like elements are numbered alike.

DETAILED DESCRIPTION

In an embodiment of the invention, as described and illustrated herein, an electronic sheet product dispenser is provided with an auxiliary feed push button that can serve to advance sheet product independent of a primary feed sensor, such as a proximity sensor where the dispenser is operated in "On-Demand Mode" or a tear sensor when the dispenser is operated in "Hang Mode", for example, or can serve to override a motor-stop-signal generated by a tear sensor that may be jammed in an incorrect position resulting from paper jamming. In an embodiment, the auxiliary feed push button is located for access by a user at the front cover of the dispenser when the front cover is closed, and is disposed in operable communication with a maintenance switch button that is internally mounted within the dispenser and behind the front cover. In an embodiment, the maintenance switch button provides the same functionality with the front cover open as does the auxiliary feed push button with the front cover closed.

When operated in On-Demand Mode, the dispenser does not present or advance a user-portion of sheet product until a user requests or "demands" such a user-portion by activating a proximity sensor. As such, a request for sheet product when operated in On-Demand Mode is the result of a proximity sensor providing a signal representative of such a request to a controller for initiating a new dispense cycle. When operated in Hang-Mode, the dispenser presents for the taking a user-portion of sheet product. Upon removal of the user-portion by a user, a tear sensor is activated that initiates a new dispense cycle. As such, a request for sheet product when operated in Hang Mode is the result of a tear sensor providing a signal representative of such a request to a controller for initiating a new dispense cycle that results in a new user-portion of sheet product being presented for the taking by a user. While embodiments employing an auxiliary feed push button are discussed herein in reference to a dispenser operating in Hang Mode, it will be appreciated that the scope of the invention is not so limited and may also apply to a dispenser operating in On-Demand Mode.

Figure 1:
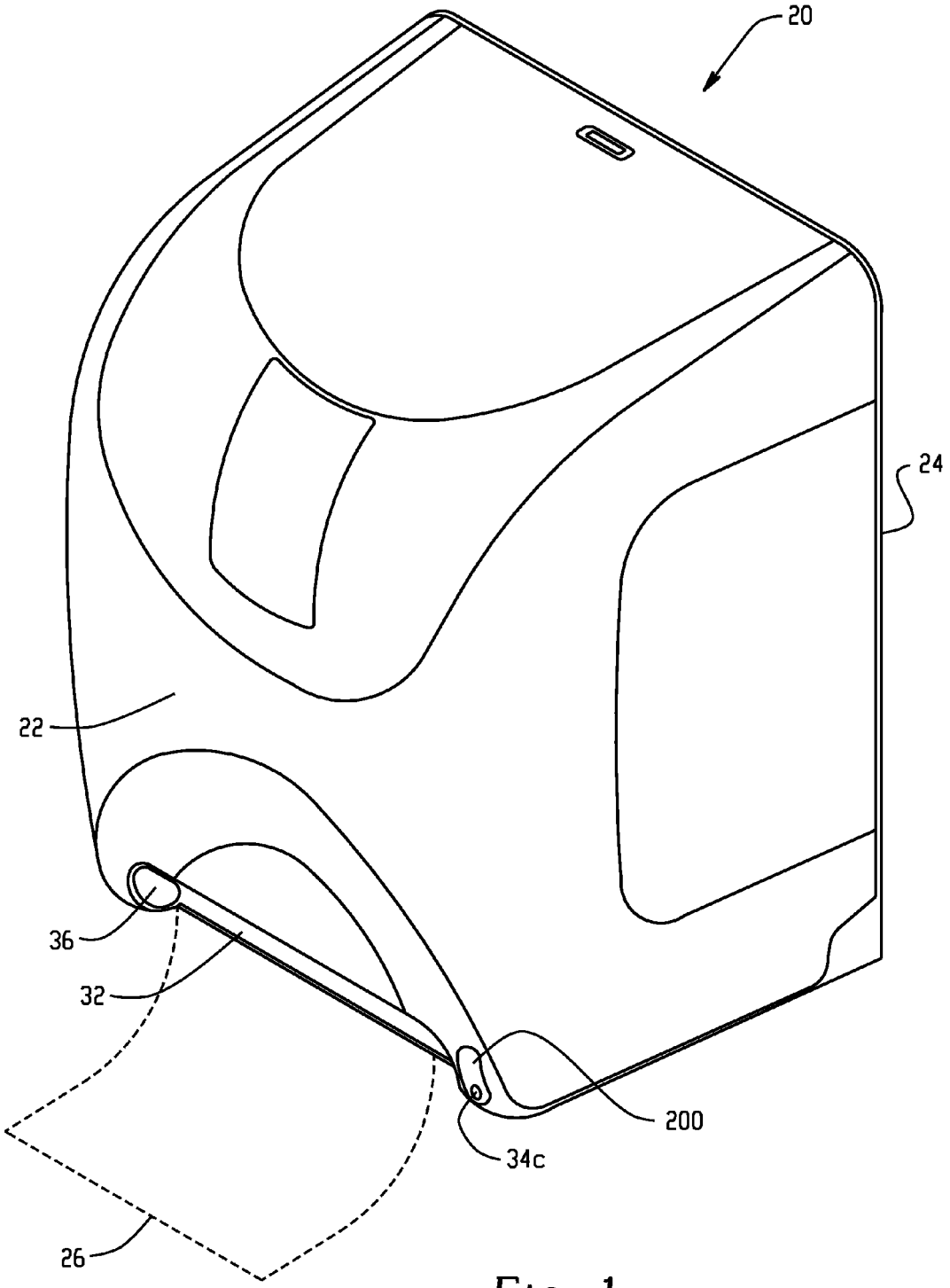
FIG. 1 is a perspective view illustration of a sheet product dispenser in accordance with an embodiment of the invention.
Figure 2:
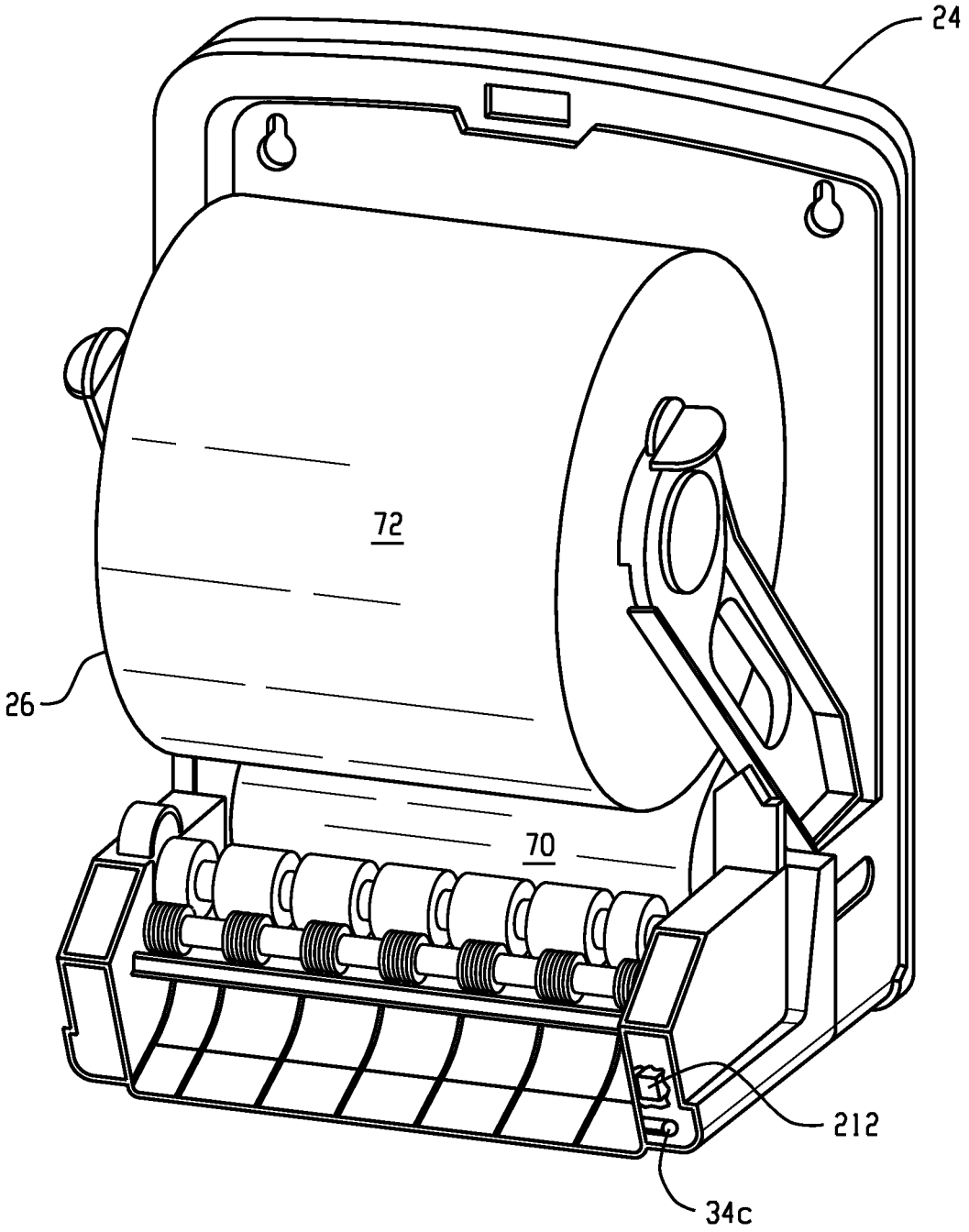
FIG. 2 is a perspective view illustration of the sheet product dispenser of FIG. 1 with the front cover removed.
Figure 3:
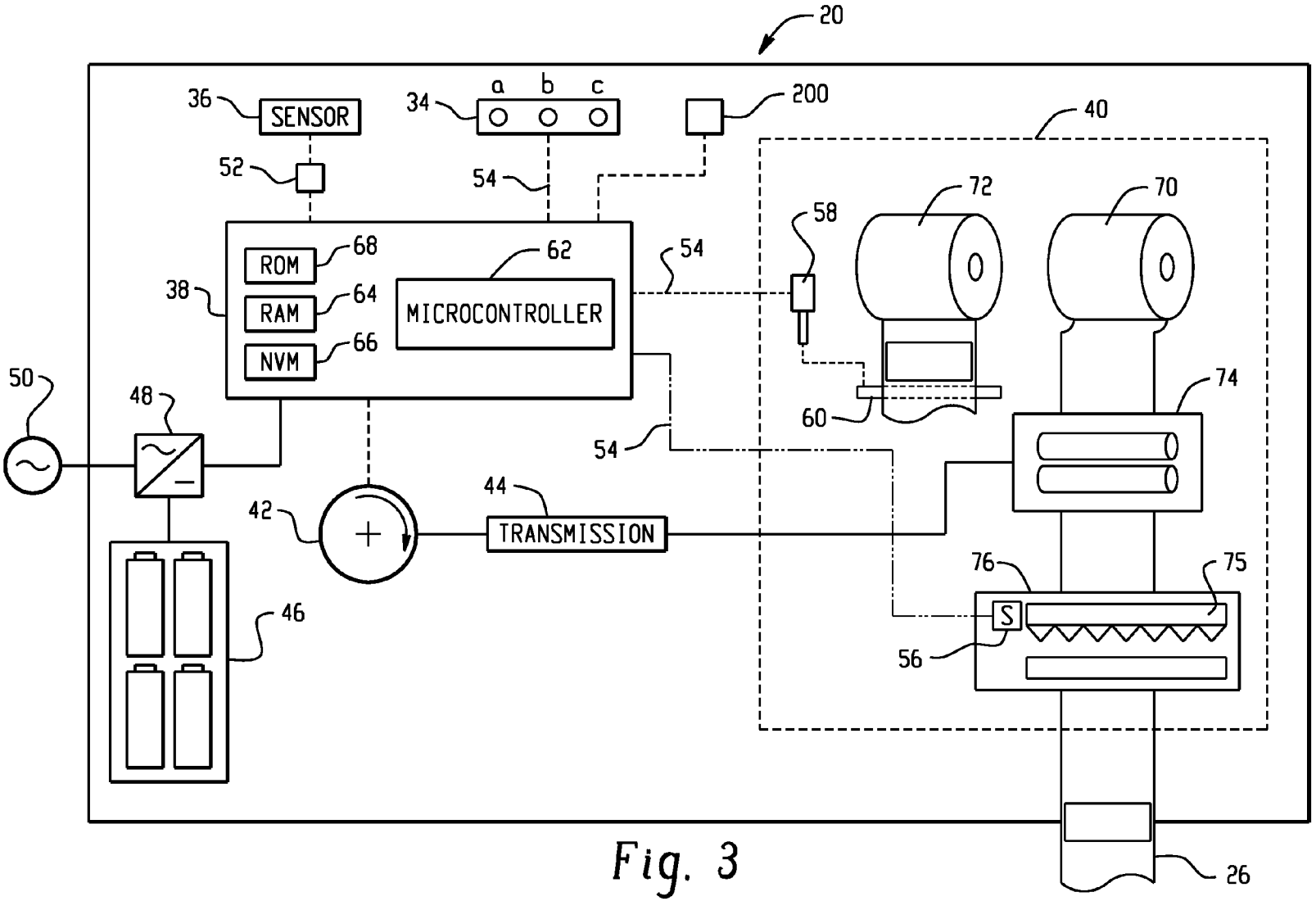
FIG. 3 is a schematic view illustration of the sheet product dispenser of FIG. 1.

FIGS. 1-3 illustrate an exemplary embodiment of a sheet product dispenser 20. The sheet product dispenser 20 includes a front cover 22 and a back plate 24 that is arranged to hold and dispense a sheet product 26. Collectively, the front cover 22 and back plate 24 may herein be referred to as a housing. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and melt-blown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

The sheet product dispenser 20 provides room in the interior of the sheet product dispenser 20 for a full roll of sheet product. The front cover 22 may be formed from any suitable material, such as a plastic, that is cost effective and meets the environmental requirements of the application. In the exemplary embodiment, the front cover 22 may be opaque, translucent or tinted. If the front cover 22 is translucent, it may provide advantages in allowing maintenance personnel to quickly determine the quantity of sheet product 26 remaining in the sheet product dispenser 20.

The sheet dispenser may include one or more light-emitting-diodes (LED's) 34 (LED 34*c* shown in FIG. 2, LEDs 34*a, b, c* shown in FIG. 3) to provide a visual indication as to the status of the sheet dispenser. In an embodiment of a dispenser 20 configured to operate in Hang Mode, a tear sensor 56 (discussed in detail below with reference to FIGS. 6-14) may be appropriately positioned within the dispenser 20 for signaling to a main controller 38 (shown in FIG. 3) to initiate a new dispense cycle. In an embodiment of a dispenser 20 operating in On-Demand Mode, a proximity sensor 36 may also be positioned adjacent the front cover 22 near the slot 32. The proximity sensor 36 may be any suitable sensor, such as an infrared sensor for example, that is capable of sensing the presence of a user's hand in front of the sheet product dispenser 20. An auxiliary feed push button 200 is disposed on the front cover 22 in a manner that makes it visible and accessible to a user when the front cover 22 is closed, while being aligned with an internally mounted maintenance switch button 212, and while covering LED 34*c*. When the front cover 22 is open, such as when maintenance personnel replace a roll of sheet product 26 for example, the switch button 212 may be actuated by the maintenance personnel in order to advance sheet product 26 to set up the sheet product dispenser 20 for dispensing. As such, the switch button 212 may herein be referred to as a switch button, a maintenance switch, or simply as a switch. The auxiliary feed push button 200 and switch button 212 will be discussed in more detail below.

A schematic representation of the major components of the sheet product dispenser 20 is shown in FIG. 3. It should be appreciated that the illustration in FIG. 3 is for purposes of description and that the relative size and placement of the respective components may differ. The sheet product dispenser 20 includes a main controller 38. As will be described in more detail herein, the main controller 38 provides logic and control functionality used during operation of the sheet product dispenser 20. Alternatively, the functionality of the main controller 38 may be distributed to several controllers that each provides more limited functionality to discrete portions of the operation of sheet product dispenser 20. The main controller 38 is coupled to a dispensing mechanism 40 to dispense a sheet product 26 when activated by a user. A motor 42 and an optional transmission assembly 44 drive the dispensing mechanism 40. The optional transmission assembly 44, such as a gearbox for example, adapts the rotational output of the motor 42 for the dispensing of the sheet product 26.

In the exemplary embodiment, the electrical energy for operating the sheet product dispenser 20 is provided by a battery 46, which may be comprised of one or more batteries arranged in series or in parallel to provide the desired energy. In an embodiment, and to minimize maintenance costs, the amount of stored energy allows for the dispensing of 48,000 feet of sheet product. In the illustrated embodiment, the battery 46 includes four 1.5-volt "D" cell batteries, however, other quantities of battery cells may be employed, such as three 1.5-volt "D" cell batteries, for example. The battery 46 is connected to the main controller 38 via an optional power converter 48 that adapts the electrical output of the battery 46 to that desired for operating the sheet product dispenser 20. The optional power converter 48 may also accept an input from an external power source, such as an alternating current ("AC") power source 50. The AC power source 50 may be any conventional power source, such as a 120V, 60 Hz wall outlets for example.

The main controller 38 is a suitable electronic device capable of accepting data and instructions, executing the instructions to process the data, and presenting the results. Main controller 38 may accept instructions through a user interface, or through other means such as but not limited to a proximity sensor, a mechanical switch, a tear sensor, voice activation means, manually-operable selection and control means, radiated wavelength and electronic or electrical transfer. Therefore, main controller 38 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

Main controller 38 is capable of converting the analog voltage or current level provided by sensors, such as proximity sensor 36 or a tear sensor 56, for example, into a digital signal indicative of a towel dispense request. Alternatively, proximity sensor 36 or tear sensor 56 may be configured to provide a digital signal to main controller 38, or an analog-to-digital (A/D) converter 52 maybe coupled between sensor and main controller 38 to convert the analog signal provided by sensor into a digital signal for processing by main controller 38. Main controller 38 uses the digital signals as input to various processes for controlling the sheet product dispenser 20. The digital signals represent one or more sheet product dispenser 20 data including but not limited to proximity sensor activation, stub roll empty, tear bar activation, motor current, motor back electromotive force, battery level and the like. Although both a proximity sensor 36 and a tear sensor 56 are shown, only one may be provided in some embodiments. In an embodiment, one of the LEDs 34, such as 34*c*, is used to indicate a monitored feature of the dispenser 20, such as a low battery condition, a jam condition, or activation of a dispense cycle, for example.

Main controller 38 is operably coupled with one or more components of sheet product dispenser 20 by data transmission media 54. Data transmission media 54 includes, but is not limited to, solid-core wiring, twisted pair wiring, coaxial cable, and fiber optic cable. Data transmission media 54 also includes, but is not limited to, wireless, radio and infrared signal transmission systems. Main controller 38 is configured to provide operating signals to these components and to receive data from these components via data transmission media 54. Main controller 38 communicates over the data transmission media 54 using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, RS-485, ModBus, or any other communications protocol suitable for the purposes disclosed herein.

The main controller 38 may also accept data from sensors, such as tear sensor 56 for example, and devices such as motor 42 and electromechanical actuator 58 for example. Main controller 38 is also given certain instructions from an executable instruction set for the purpose of comparing the data from tear sensor 56 to predetermined operational parameters.

Main controller 38 includes a processor 62 coupled to a random access memory (RAM) device 64, a non-volatile memory (NVM) device 66, and a read-only memory (ROM) device 68. Main controller 38 may optionally be connected to one or more input/output (I/O) controllers or data interface devices (not shown). NVM device 66 is any form of non-volatile memory such as an EPROM (Erasable Programmable Read Only Memory) chip, an EEROM (Electronically Erasable Read Only Memory), a flash memory chip, a disk drive, or the like. Stored in NVM device 66 are various operational parameters for the application code. It should be recognized that application code could be stored in NVM device 66 rather than ROM device 68.

Main controller 38 includes operation control methods embodied in application code. These methods are embodied in computer instructions written to be executed by processor 62, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

The illustrated dispensing mechanism 40 also includes at least two sheet products 70, 72 that are mounted on rolls or core stock. However, in an alternative embodiment, the dispenser 20 and dispensing mechanism 40 may be configured to house and dispense a single roll, which is herein contemplated and considered within the scope of the claimed invention. Maintenance personnel manually refill the sheet product dispenser 20 and position the stub roll 70 within the sheet product dispenser 20 ready for immediate dispensing. This stub roll 70 is commonly referred to as a "stub roll" since it usually, but not necessarily, contains only a portion of the sheet product of a new/full sheet product roll. However, in one embodiment the stub roll 70 can be a new or full sheet product roll. Since the stub roll 70 typically has less sheet product, it is able to fit within a lower portion of the sheet product dispenser 20. The stub roll 70 feeds sheet product to a roller assembly 74 that includes a pair of rollers that pull the sheet product when activated by motor 42. A tear bar assembly 76 is positioned adjacent the dispensing slot 32 to provide a means for separating the dispensed sheet product 26 from the stub roll 70.

After the roller assembly 74 pulls the sheet product from either the stub roll 70 or the main roll 72, the sheet product proceeds to tear bar assembly 76. The tear bar assembly 76 is positioned adjacent the dispensing slot 32. A means for cutting the sheet product 26 is included in tear bar assembly 76 once the appropriate amount of sheet product 26 has been dispensed. As will be discussed in more detail below, the tear bar assembly 76 may separate the dispensed sheet product using a sharp edge that cuts into the sheet when the user pulls the dispensed sheet product 26. The separation of the sheet product 26 from the sheet product roll 70, 72 may then be used and discarded as necessary by the user.

The tear bar assembly 76 may include a fixed tear bar 75 coupled to a movable tear bail 77, which is discussed further below in connection with FIGS. 8-13, or a movable tear bar 100, which is discussed further below in connection with FIGS. 6-7.

In an embodiment where the dispenser 20 is configured to operate in Hang Mode, a tear sensor 56 may be positioned adjacent to the tear bar assembly 76. In an embodiment having a fixed, or stationary, tear bar 75 coupled to a movable tear bail 77, the tear sensor 56 is disposed in signal communication with the movable tear bail 77, and in an embodiment having a movable tear bar 100, the tear sensor 56 is disposed in signal communication with the movable tear bar 100. As will be described in more detail herein, the tear sensor 56 provides a signal to the main controller 38 that indicates whether the dispensed portion of sheet product has been separated from the sheet product dispenser 20. In an embodiment, the detection of the sheet product being separated by the tear bar assembly 76, via the tear sensor 56, provides a positive feedback to the main controller 38 to energize a de-energized motor 42 to initiate a dispense cycle for presentation of a new user-portion of sheet product. In an embodiment employing a movable tear bail 77, the movable tear bail 77 may be spring loaded and located close to the stationary tear bar 75 so that the tear bail 77 can assist in pushing the sheet product off of the tear bar 75 if the sheet product were to stick there after a tear action by a user. In an embodiment, the spring biasing force exerted on the tear sensor 56 places the tear sensor 56 in a position herein referred to as a home position, and the tearing action of the sheet product by a user exerts a force on the tear sensor 56 that places the tear sensor 56 in a position herein referred to as an actuated position. When the tear sensor 56 moves from the home position to the actuated position and back again, a tear sensor signal indicative of a tear is provided by the tear sensor 56 to the main controller 38. If the main controller 38 does not receive positive feedback from the tear sensor 56 when it should, such as when a paper jam occurs, for example, and the jam is not self-rectified, a new dispense sequence will not occur. In this situation, a user may manually operate the auxiliary feed push button 200 to provide the main controller 38 with a signal representative of a request to dispense another length of sheet product, which will be discussed further below.

During a dispense cycle, it is possible for a user to tear sheet product from the dispenser 20 while the motor 42 is running and before the dispenser 20 has completed a full dispense cycle that would advance and present a full user-portion of sheet product. In this situation, the main controller 38 may be responsive to executable instructions to stop the motor 42 from running, wait a defined amount of time such as one second for example, and then turn the motor 42 back on to initiate a new dispense cycle. This situation of an interrupted dispense operation may be referred to as premature tearing, as opposed to a normal operation in Hang Mode where actuation of the tear sensor 56 results in completion of an uninterrupted dispense cycle.

In another embodiment where the dispenser 20 is configured to operate in Demand Mode, the main controller 38 controls the on-time of the motor 42 driving the dispensing mechanism 40 for controlled dispensing of a set sheet length, and the detection of the sheet product being separated by the tear bar assembly, via the tear sensor 56, provides a positive feedback to the main controller 38 indicative of sheet product having been removed and to prepare for a new dispense action when the proximity sensor 36 is again activated. If the main controller 38 does not receive positive feedback from the tear sensor 56 when it should, a new dispense sequence will not occur even when the proximity sensor 36 is again activated. In this situation, a user may manually operate the auxiliary feed push button 200 to cause another length of sheet product to be dispensed.

Figure 4A:
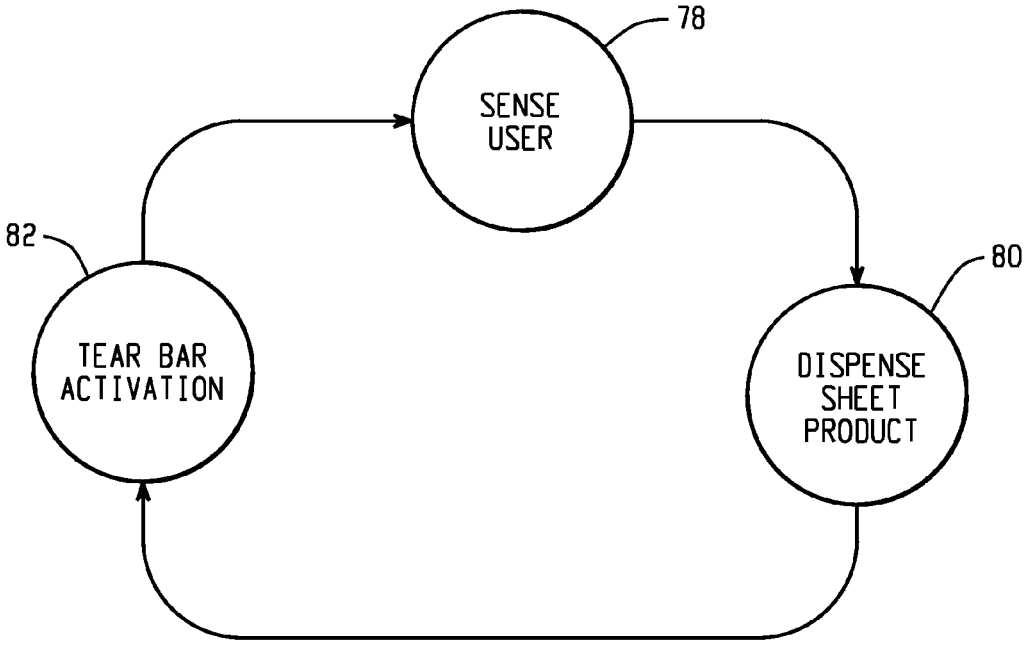
FIGS. 4A and 4B are block diagram illustrations of alternative modes of operation for the sheet product dispenser of FIG. 1.
Figure 4B:
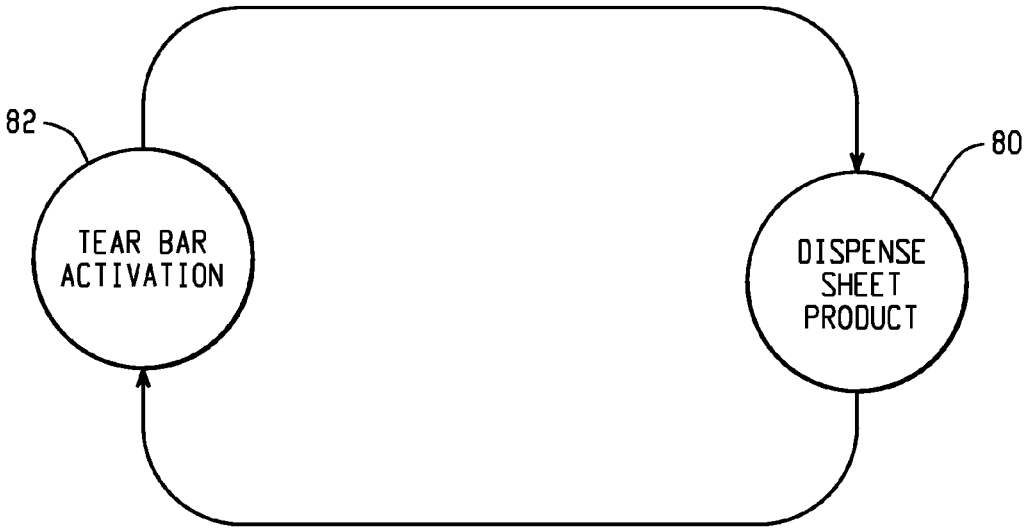

The operation of the sheet product dispenser 20 may be thought of as a series of operational modes shown in FIGS. 4A and 4B. The first mode of operation, shown in FIG. 4A and discussed above, is sometimes referred to as "On-Demand Mode". In this mode, the dispenser operates most of the time waiting for the proximity sensor 36 to provide an indication that a user needs sheet product 26. Once the main controller 38 determines a user is triggering the proximity sensor 36, the user sense 78, the main controller 38 initiates operation of the sheet product dispenser 20 to dispense 80 a sheet portion for the user. In this embodiment, the main controller 38 would then wait for the tear sensor 56 to provide a signal 82 indicating that the user has separated the dispensed portion of the sheet product 26 from the sheet product roll 70, 72. The dispenser returns to waiting for the proximity sensor 36 to provide another indication that a user needs sheet product 26.

In one embodiment, if the user determines that a sufficient amount of sheet product 26 has dispensed while the sheet product dispenser 20 is actively dispensing and they separate the dispensed sheet product 26 from the sheet product roll 70, 72, the tear sensor 56 would be activated and provide a signal to the main controller 38 which would subsequently de-energize the motor 42. This stops the rotation of the sheet product roll 70, 72.

A second mode of operation, shown in FIG. 4B and discussed above, is sometimes referred to as "Hang Mode". In this mode, the main controller 38 initiates operation of the sheet product dispenser 20 to dispense 80 a pre-determined length of the sheet product 26 to allow a full-dispensed sheet portion to be exposed to a user and immediately available for use. In this embodiment, the main controller 38 would then wait for the tear sensor 56 to provide a signal 82 indicating that the user has separated the dispensed portion of the sheet product 26 from the sheet product roll 70, 72. The main controller 38 then initiates a new dispense operation of the sheet product dispenser 20.

In the embodiment of sheet product dispenser 20 depicted in FIG. 5-10, the stub roll 70 and main roll 72 are arranged with the main roll 72 being in the upper portion and the stub roll 70 in the lower portion of sheet product dispenser 20. The roller assembly 74 includes a drive roller 86 and a pinch roller 88. The location where the rollers meet is commonly referred to as the "nip." The drive roller 86 is coupled for rotation to the motor 42. When maintenance or refill operations are performed on the sheet product dispenser 20, the stub roll 70 is positioned in the lower portion and the leading edge portion 90 of the sheet product 26 from stub roll 70 is inserted between the drive roller 86 and the pinch roller 88 at the nip. Friction between the rollers 86 and 88 and the leading edge portion 90 causes sheet product 26 to be pulled from the stub roll 70 when the motor 42 is activated. Maintenance personnel may also position the main roll 72 in the sheet product dispenser 20.

In an embodiment, the dispensing mechanism 40 may further include a transfer bar 60 that is activated by an electromechanical actuator 58 (see FIG. 3 for example). The transfer bar 60 acts to move the end portion of sheet product 26 on main roll 72 from a first position to a second position where it engages the rollers in roller assembly 74 and may thereafter be dispensed. In one embodiment, the electromechanical actuator 58 is a solenoid having a wound coil core and a movable plunger. The plunger moves in response to the core being energized. A spring, or other similar device may be used to return the plunger to its original position once the core is de-energized. The electromechanical actuator 58 may also be a rotary solenoid, a motor, a shape metal alloy, an electromagnet, or a piezoelectric device for example. The core is electrically coupled to the main controller 38.

In another embodiment, the dispensing mechanism 40 may not include a transfer bar 60, but instead may rely on double-feeding of the stub roll 70 and the main roll 72 when transferring from dispensing of sheet product 26 from a near-depleted stub roll 70 to dispensing of sheet product 26 from a fuller main roll 72. Such double-feeding may be the result of maintenance personnel seeking to avoid depletion of the stub roll 70 before they can return to the dispenser 20 to manually transfer the dispensing to the main roll 72.

Figure 5:
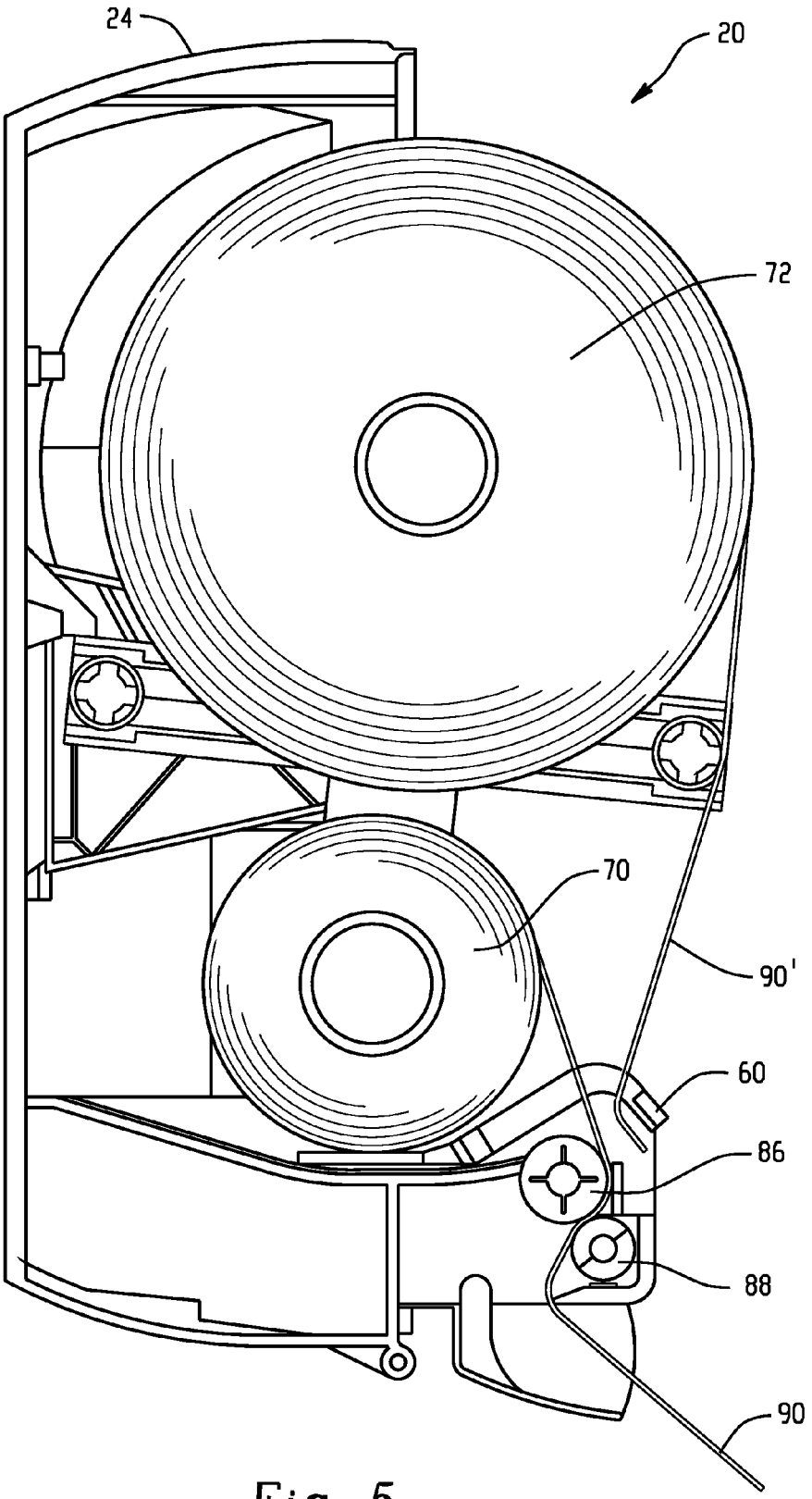
FIG. 5 is a side plan view illustration of a sheet product dispenser similar to that of FIG. 1 with the front cover removed.

In an embodiment having a transfer bar 60, referring now to FIG. 5, the main roll 72 includes a leading edge portion 90' that is positioned adjacent the transfer bar 60. An arm on the transfer bar 60 extends parallel to the drive roller 86 transversely across the front of the sheet product dispenser 20 to engage the main roll leading edge portion 90'. From the foregoing, it will be appreciated that further reference herein to the leading edge portion 90 of the stub roll 70 with regard to a dispensing action when sheet product is being dispensed from the stub roll 70, may also be applicable to the leading edge portion 90' of the main roll 72 when sheet product is being dispensed from the main roll 72.

Figure 6:
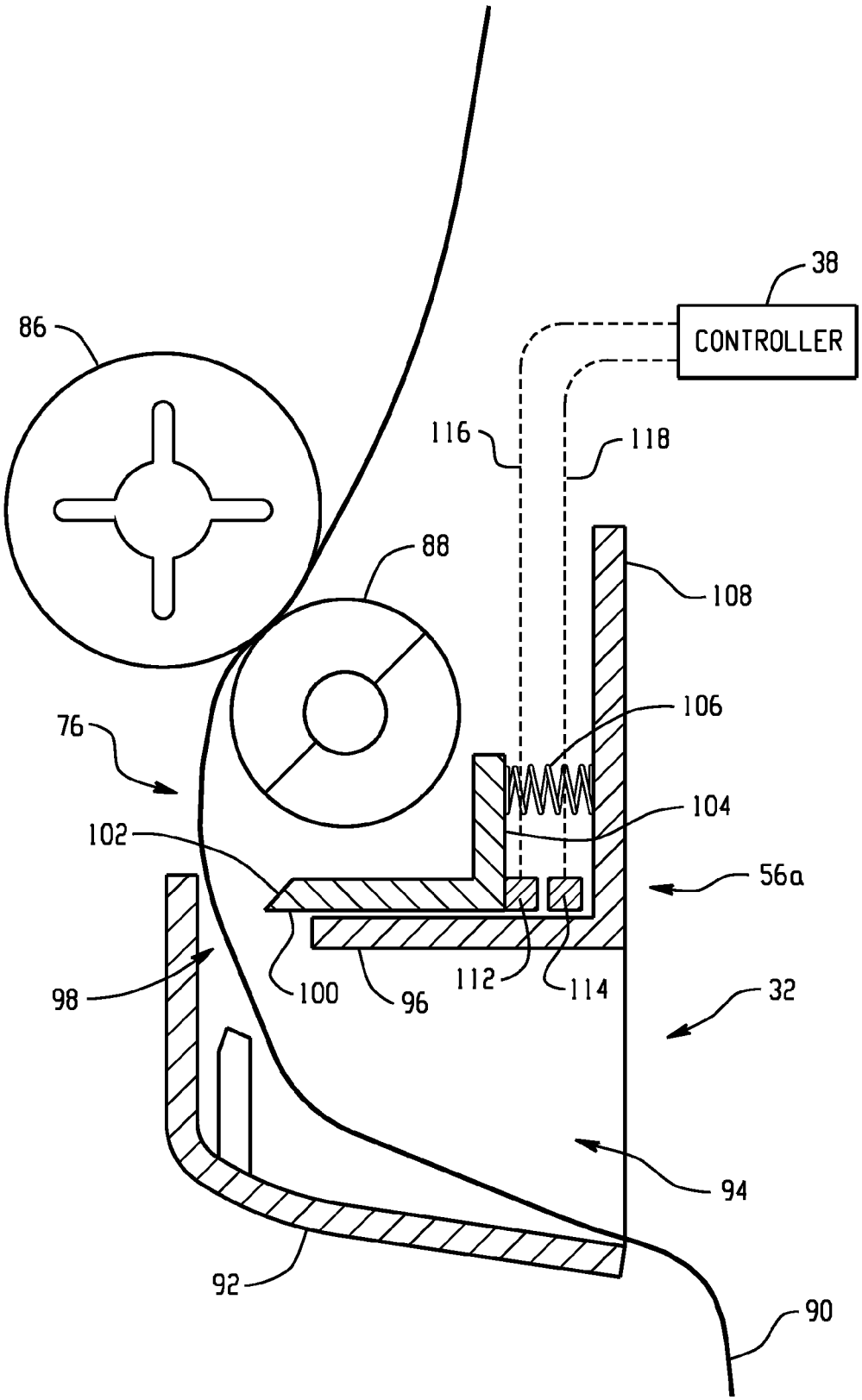
FIG. 6 is a partial side plan view illustration of the sheet product dispenser of FIG. 1 with an embodiment of a tear bar and a tear sensor.

In an embodiment, the tear bar assembly 76 is positioned adjacent to the dispensing slot 32 as illustrated in FIG. 6. The leading edge 90 passes through the rollers 86, 88 and into the dispensing slot 32. The dispensing slot 32 is the portion of the sheet product dispenser 20 where the sheet product 26 exits and is accessible to the user. The housing 22, 24 includes a curved surface 92 that is arranged along the bottom of the housing 22, 24 and provides a means for guiding the sheet product from the rollers 86, 88 to the opening 94 of the dispensing slot 32. Opposite the surface 92 the housing 22, 24 includes a projection 96 that extends generally perpendicular from the front of the housing 22, 24 back towards the rollers 86, 88. The curved surface 92 and the projection 96 cooperate to form an opening 98 at the entrance to the dispensing slot 32.

In the embodiment illustrated in FIG. 6, a movable tear bar 100 is slidably coupled to the projection 96. The tear bar 100 may be slidably fixed to the projection 96 by any suitable means, such as by having threaded fasteners captured in slots for example. As will be discussed in more detail below, the tear bar 100 is arranged to move in a direction parallel to the projection 96. The tear bar 100 further includes a blade edge 102 that is positioned adjacent the opening 98 and adjacent the path of the sheet product leading edge portion 90. The blade edge 102 may be a knife-edge, a serrated edge or any other suitable edge capable of cutting the sheet product leading edge portion 90 from the sheet product roll 70, 72. The tear bar 100 also includes a back surface 104 opposite edge 102. An elastic member 106, such as a compression spring for example, is positioned between the back surface 104 and wall 108. Wall 108 may be part of the tapered portion 30, or an extension of the projection 96. In either case, the wall 108 provides a relatively fixed location allowing the spring 106 to bias the tear bar 100 towards the opening 98.

Tear bar assembly 76 as illustrated in FIG. 6 also has a tear sensor **56*a* that includes a first electrical contact 112 and a second electrical contact 114. The first electrical contact 112 is coupled to the back surface 104 of tear bar 100 and is arranged to move with the tear bar 100. The second electrical contact 114 is positioned in a fixed arrangement relative to the housing 24. In the exemplary embodiment, the second electrical contact 114 is coupled to the projection 96. In an alternate embodiment, the second electrical contact 114 is coupled to the wall 108. Electrical conductors 116, 118 electrically couple the first electrical contact 112 and the second electrical contact 114 to the main controller 38** respectively.

In an embodiment during a Hang Mode operation, the sheet product dispenser 20 presents a full user-portion of sheet product 26 via dispensing slot 32. A user may then pull on the sheet product causing the sheet product in the opening 98 to engage the edge 102 of tear bar 100. Since the tear bar 100 is slidably mounted, the tear bar 100 moves under the force of sheet product being pulled by the user. The tear bar 100 continues to move until the first electrical contact 112 comes into contact with the second electrical contact 114. The electrical contact of the electrical contacts 112, 114 stops any further travel by the tear bar 100. An edge 102 thereafter completes the cutting of the sheet product, allowing the user to remove the separated sheet.

The contact of the electrical contacts 112, 114 also completes an electric circuit formed by the electrical contacts 112, 114, the electrical conductors 116, 118 and the main controller 38. The completion of this circuit allows a signal to be transmitted to the main controller 38 indicating that the tear bar 100 has been moved. From this signal, the main controller 38 may infer that the sheet product 26 has been separated and that a new dispensing cycle should be initiated.

Figure 7:
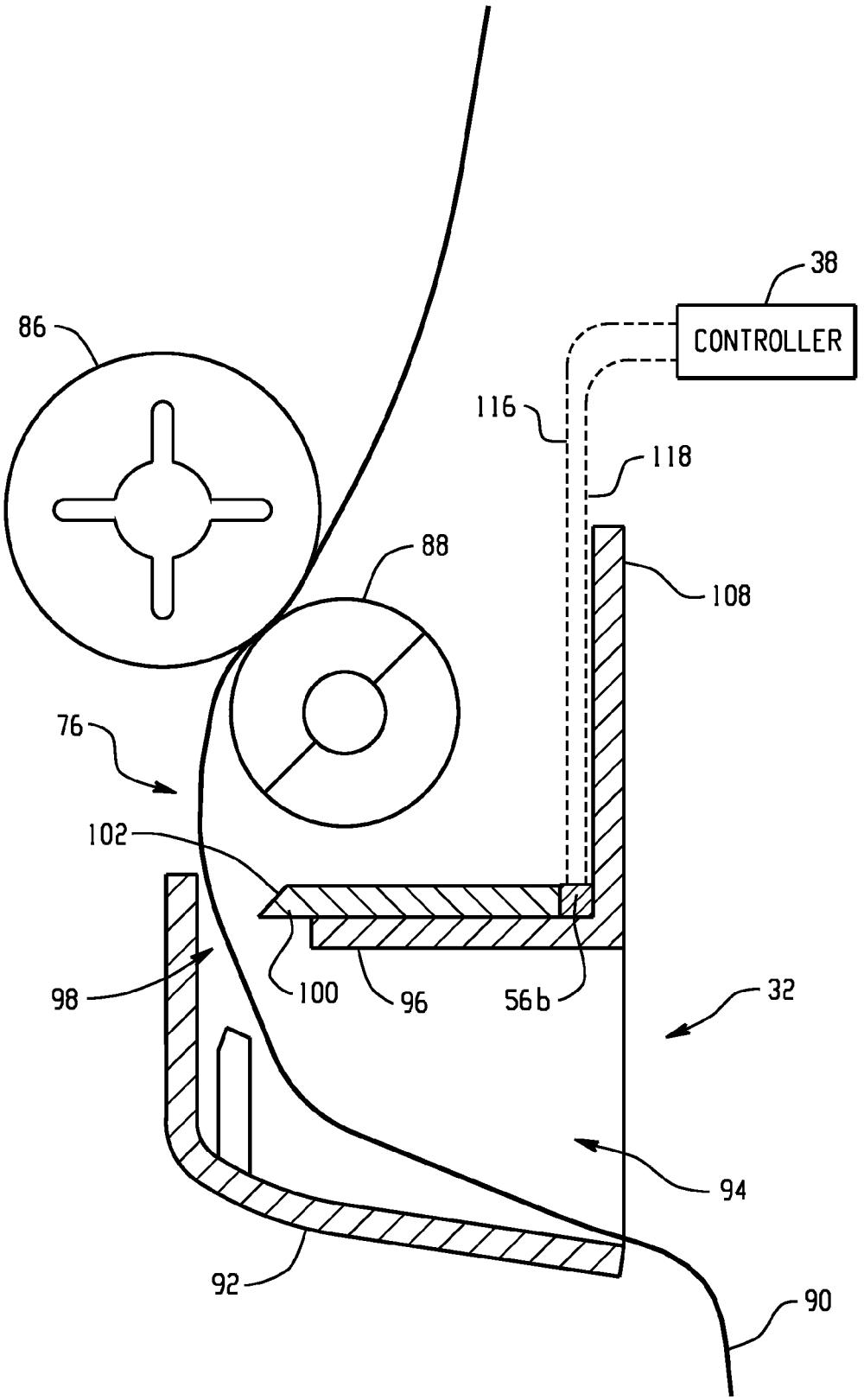
FIG. 7 is a partial side plan view illustration of the sheet product dispenser of FIG. 1 with an alternate embodiment of a tear bar and a tear sensor.

An alternate embodiment of a tear bar assembly 76 is shown in FIG. 7. In this embodiment, a movable tear bar 100 is slidably coupled to the housing projection 96. As discussed above, the tear bar 100 and projection 96 may be coupled in any suitable manner that allows the tear bar 100 to move over a defined range, such as a slot and bolted connection for example. In the example embodiment, the sliding plane is parallel to the surface of projection 96, however, the claimed invention should not be so limited. The tear bar 100 includes an edge 102 that is positioned adjacent to the path of the sheet product 26 entering the opening 98.

As illustrated in FIG. 7, a piezoelectric tear sensor 56*b* is coupled between the side of the tear bar 100 opposite the edge 102, and the wall 108. In the example embodiment, the piezoelectric tear sensor 56*b* is not attached to the projection 96, allowing the piezoelectric tear sensor 56*b* to be compressed as discussed in more detail below. The piezoelectric tear sensor 56*b* deforms elastically when compressed and returns the tear bar 100 to its original position once the load is removed. In the example embodiment, the direction of compression is in the plane that the tear bar 100 slides.

The piezoelectric tear sensor 56*b* may be a low cost thick film having an analog voltage signal output. In one embodiment, the piezoelectric tear sensor 56*b* comprises a thin piezoelectric PVDF film laminated to a flexible planar substrate. The piezoelectric tear sensor 56*b* has a physical attribute that allows it to self-generate an electrical signal when compressed. The magnitude of the electrical signal is in proportion to the mechanical deformation of the sensor. An advantage of a piezoelectric tear sensor 56*b* is that it generates a voltage signal in relation to the magnitude of the compression and does not depend on closing electrical contacts. A pair of electrical conductors 116, 118 couples the piezoelectric tear sensor 56*b* to the main controller 38. The analog voltage signal can be filtered for voltage amplitude or frequency by the main controller 38. Frequency filtering can remove signals due to vibration.

In an embodiment during a Hang Mode operation, the sheet product dispenser 20 activates to advance and present a full user-portion of sheet product 26, such as in response to a signal from the piezoelectric tear sensor 56*b* for example. A user may then pull on the sheet product 26 causing the sheet product 26 adjacent opening 98 to engage the tear bar edge 102. This contact by the sheet product 26 against the tear bar 100 causes a small deformation of the piezoelectric tear sensor 56*b* as the sheet product 26 is separated from the sheet product roll 72, 70. The deformation creates a voltage signal that is transmitted over the electrical conductors 116, 118 to main controller 38. Upon receiving the voltage signal from piezoelectric tear sensor 56*b*, the main controller 38 may infer that the sheet product 26 has been separated and that a new dispensing cycle should be initiated.

Figure 8:
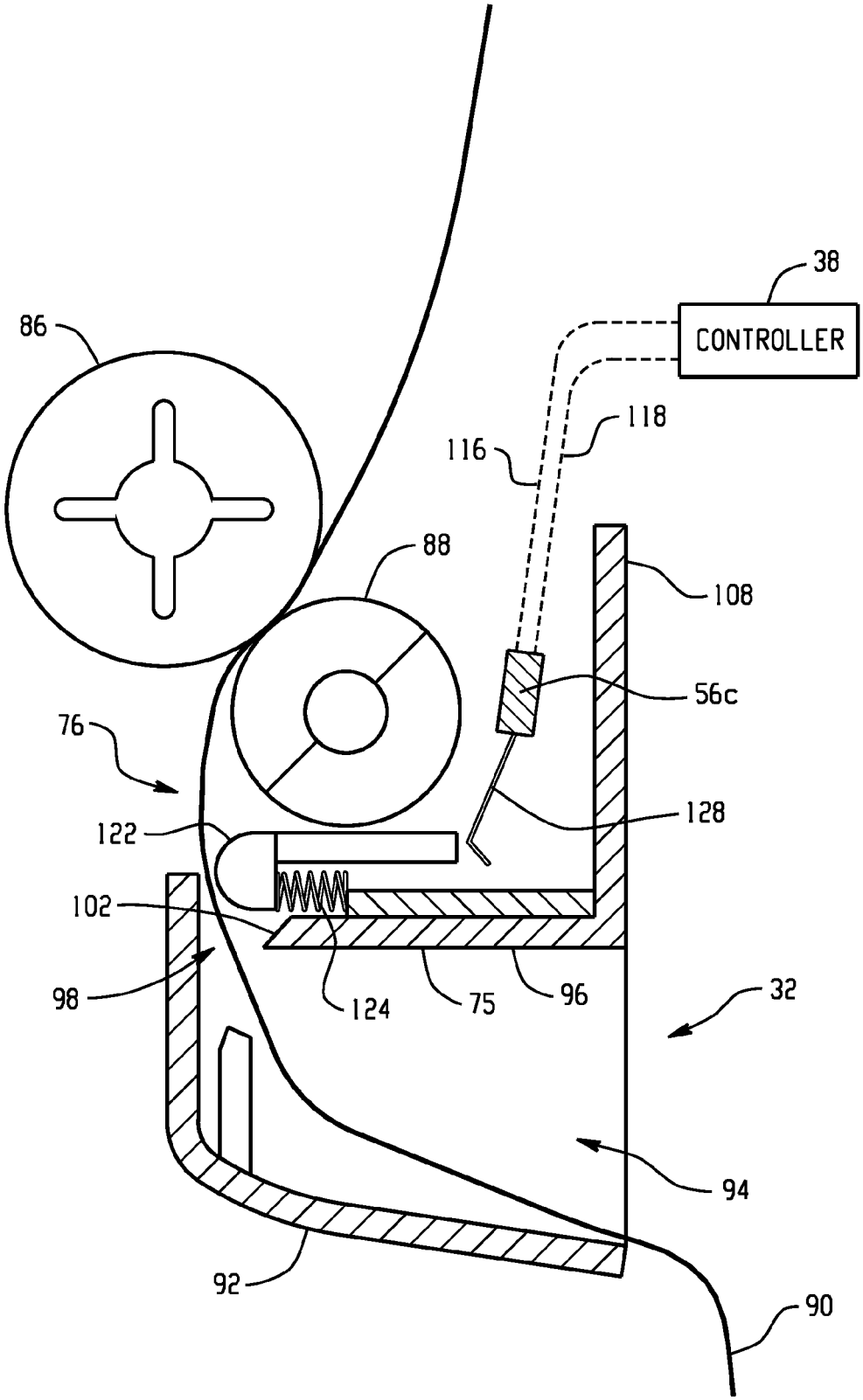
FIG. 8 is a partial side plan view illustration of the sheet product dispenser of FIG. 1 with another alternate embodiment of a tear bar and a tear sensor.

Another alternate embodiment is illustrated in FIG. 8. In this embodiment, a movable tear bail 122 is slidably arranged adjacent the opening 98. The tear bail 122 includes a smooth curved portion 124 that is positioned in the path of the sheet product 26. The tear bail 122 is slidably coupled to the front cover 22 to allow motion in a plane generally parallel to a fixed tear bar 75. The tear bar 75 is integrated with the housing projection 96. The tear bar edge 102 is positioned adjacent to the opening 98. It should be appreciated that while the tear bar 75 is illustrated as being integrated into the housing projection 96, a separate tear bar may alternately be mounted to the projection 96. In this alternate arrangement, the tear bar 75 would be fixedly coupled to the projection 96 so that there would be no relative motion therebetween.

As illustrated in FIG. 8, a compression spring 124 is arranged between the tear bail 122 and the housing wall 108. The spring 124 biases the tear bail 122 towards the sheet product 26 traveling though the tear bar assembly 76. The spring 124 is sized to provide sufficient force on the tear bail 122 to prevent deflection, or at least a large deflection, of the tear bail 122 during normal operation. However, the spring 124 is also sized to allow the deflection of the tear bail 122 when the user pulls the sheet product 26. A tear sensor switch 56*c*, such as a microswitch for example, is arranged adjacent the tear bail 122. The tear sensor switch 56*c* includes an arm 128 that is positioned adjacent the tear bail 122. As will be discussed below, the arm 128 is positioned to allow activation of the tear sensor switch 56*c* in response to movement of the tear bail 122.

The curved portion of tear bail 122 is arranged to guide the sheet product 26 as it is dispensed from the sheet product dispenser 20 into the dispensing slot 32. The curved portion of tear bail 122 further maintains a gap between the sheet product 26 and the tear bar edge 102. This gap helps prevent contact of the edge 102 by the sheet product 26 that may cause inadvertent or premature separation of the sheet product 26. In an embodiment during a Hang Mode operation, the sheet product dispenser 20 activates to advance and present a full user-portion of sheet product 26, such as in response to a signal from the tear sensor switch 56*c* for example. During advancement of the sheet product 26, the sheet product 26 slides over the tear bail 122 and into the dispenser slot 32. A user may then pull on the sheet product 26 causing the spring 124 to compress and tear bail 122 to deflect. Once the tear bail 122 has deflected a sufficient amount, the sheet product 26 adjacent opening 98 engages the tear bar edge 102 causing the sheet product 26 to separate from the sheet product rolls 70, 72.

The deflection of the tear bail 122 also results in a deflection of the arm 128 and activation of the tear sensor switch 56*c*. The tear sensor switch 56*c* sends an electrical signal over electrical conductors 116, 118 to main controller 38. Upon receiving the voltage signal from switch 56*c*, the main controller 38 may infer that the sheet product 26 has been separated and that a new dispensing cycle should be initiated. It should be appreciated that while the embodiment illustrated in FIG. 8 shows a tear sensor switch 56*c*, any type of sensor that is capable of detecting movement of the tear bail 122 may be used. For example, the piezoelectric tear sensor 56*b* discussed herein may also be used. Other sensors may also be used in place of tear sensor switch 56*c*, such as optical sensors or magnetic switches, for example.

Figure 9:
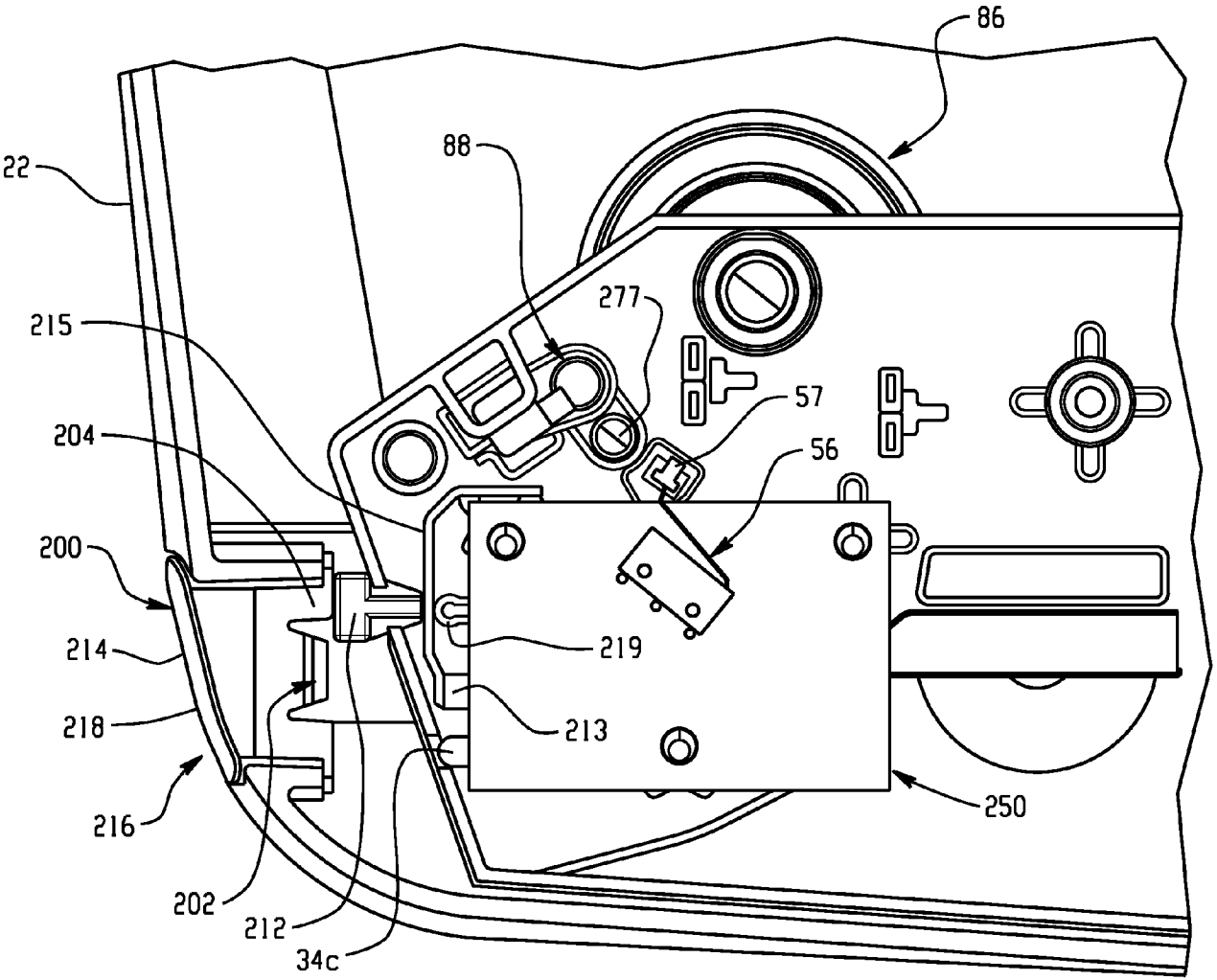
FIG. 9 is a partial side plan view illustration of the sheet product dispenser of FIG. 1 with another alternative embodiment of a tear bar and a tear sensor.
Figure 10:
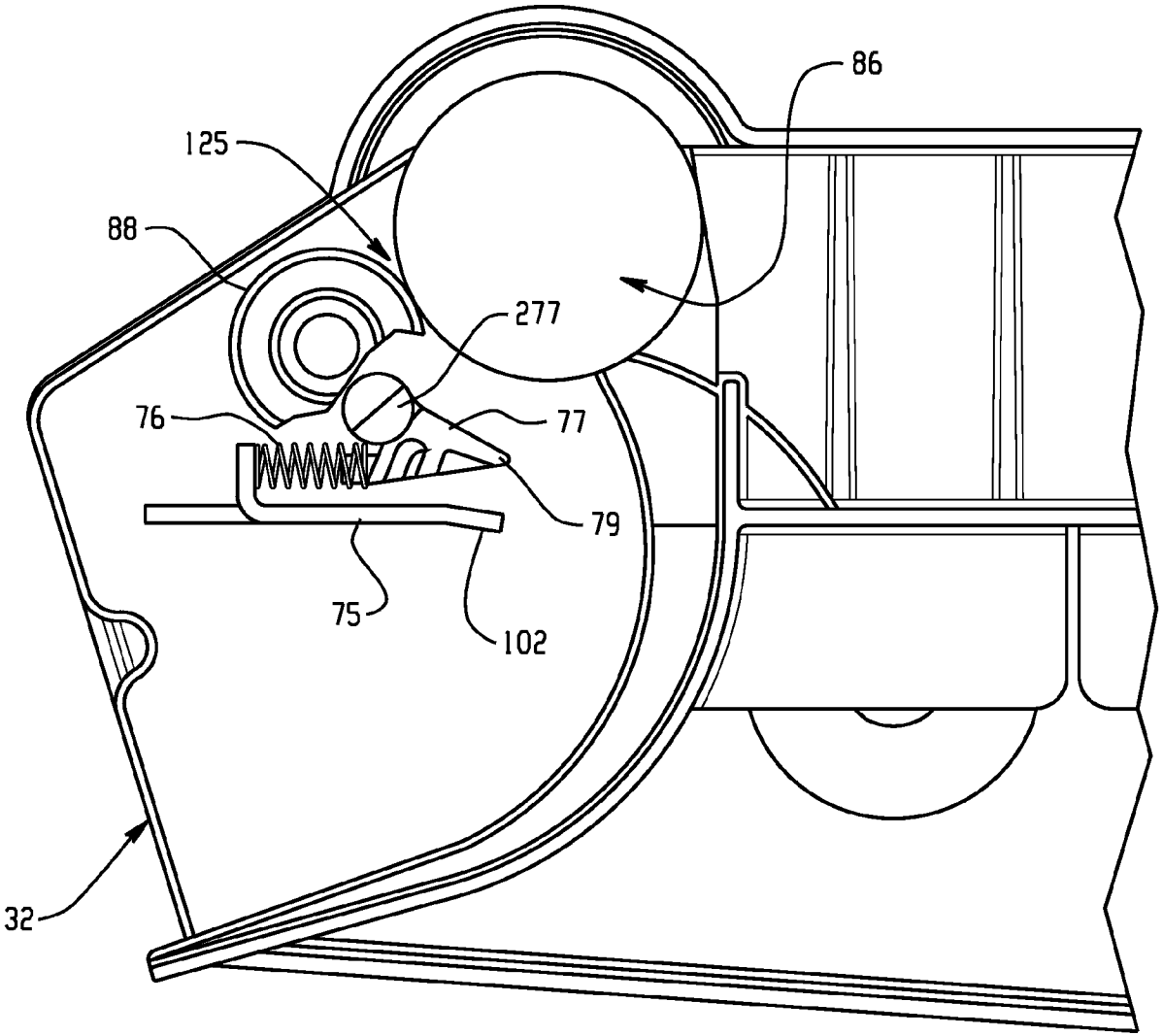
FIG. 10 is a partial side plan view of FIG. 9 with detail removed for clarity.

Another alternate embodiment is illustrated in FIGS. 9 and 10, which will now be discussed with reference also to FIGS. 1-3.

As previously discussed, if the main controller 38 does not receive positive feedback from the tear sensor 56 when it should, that is, a signal from the tear sensor 56 is not indicative of the tear sensor 56 having moved from a home position to an actuated position and back again, a new dispense sequence will not occur, which may be the result of the tear sensor 56 getting stuck in the actuated position by a paper jam. When the dispenser 20 is configured to operate in Hang Mode, such an occurrence may render the dispenser 20 inoperable. To resolve such a situation the auxiliary feed push button 200 may be provided for activation by a user, which will now be discussed in more detail.

FIG. 1 depicts the auxiliary feed push button 200 disposed over LED 34*c* and over the internally mounted maintenance switch button 212, which are depicted in more detail in FIGS. 9 and 10. With reference now to FIG. 9, the push button 200 is fit into an opening in the front cover 22 of dispenser 20 from the interior side of the front cover 22 and is held in place via snap fit features 202. A protrusion 204 on the rear side of push button 200 is configured to prevent the push button 200 from traveling too far forward out of the front cover 22 once the push button 200 is in place. As illustrated, the protrusion 204 is also configured to engage the internally mounted maintenance switch button 212, which is disposed to actuate a microswitch 213 mounted to a printed circuit board (PCB) 250 via a spring member 215 that is also mounted to the PCB 250. The spring member 215 biases the maintenance switch button 212 against the protrusion 204 of the push button 200, which in turn biases the protrusion 204 of the push button 200 against stops in the cover 22. As illustrated, the maintenance switch button 212 is disposed behind the front cover 22 in operable relationship with the protrusion 204 of the push button 200 such that when a user depresses the push button 200 via actuation surface 214 the spring member 215 is compressed sufficiently to permit the protrusion 204 to actuate the switch button 212 and the microswitch 213. Upon actuation, the microswitch 213 sends a signal to the main controller 38 which is interpreted by the main controller 38 as a request for dispensing a length of sheet product. As such, if the main controller 38 does not receive positive feedback from the tear sensor 56 when it should, manual actuation of the push button 200 can serve as an override operable by the user. However, it will also be appreciated that the push button 200 can be actuated even if the tear sensor 56 is operating properly. In such a situation, the push button 200 can serve as a means for a user to have the dispenser 20 dispense a second length of sheet product in addition to the first length that was correctly dispensed by the dispenser 20.

In an embodiment, depressing the push button 200 results in continuous running of the motor 42 and dispensing of sheet product 26 up to a first predetermined amount of time, at which time the motor 42 will stop running. If the push button 200 is held in a depressed state, the main controller 38 may be configured to implement a time-out procedure whereby the motor 42 will stop running after a second predetermined amount of time has passed. The first and second predetermined amounts of time may be the same or different. If additional dispensing of sheet product 26 is desired the user can release the push button 200 and depress it again. While a certain dispensing logic has been described in relation to actuation of the push button 200, it will be appreciated that the scope of the invention is not so limited and also encompasses other dispensing logic suitable for a purpose disclosed herein.

Further depicted in FIG. 9 is a lower portion 216 of the push button 200, which includes a viewing window 218 that may or may not have an integrally formed lens. As the push button 200 is depressed the viewing window 218 gets closer to the LED 34*c*, thereby enabling the light emitted from LED 34*c* to be more readily visible to a user or maintenance personnel. In another embodiment, the viewing window 218 may be clear and without purposeful magnification, thereby enabling the emitted light from LED 34*c* to be readily seen with or without depression of the push button 200. Also depicted in FIG. 9 is a rib 219 mounted to or integrally formed from the housing 22, 24 a chassis disposed within the housing. The rib 219 is disposed on an opposing side of the spring member 215 to that of the switch button 212 so as to provide a positive stop for the switch button 212 so that excessive force applied to the auxiliary feed push button 200 upon depression thereof does not damage the switch button 212, the microswitch 213, or the PCBA 250.

Comparing FIG. 9 with FIG. 10, which depicts portions of FIG. 9 with the PCBA 250 omitted for clarity, common features between the two illustrations can be seen, such as the drive roller 86, the pinch roller 88 (portions removed for clarity), and a tear bail pivot 277, for example, which establishes positional relationships between the structural features of both FIGS. 9 and 10. For example, the tear bail 77 as depicted in FIG. 10 is disposed to rotate about the tear bail pivot 277 as depicted in FIG. 9, and the tear bail end 79 as depicted in FIG. 10 is disposed to actuate a tear bail switch contact 57 as depicted in FIG. 9, which in turn actuates the tear sensor 56. The tear bail 77 is spring biased toward the nip 125 and is functionally disposed between the nip 125 and the tear bar 75, such that as sheet product 26 passes through the nip 125 toward the dispensing slot 32, the sheet product 26 first passes over the tear bail end 79 of the tear bail 77 and then over the end of the tear bar 75, which includes a blade edge 102 that may be a knife-edge, a serrated edge or any other suitable edge capable of cutting the sheet product 26. The action of a user tearing off a length of dispensed sheet product 26 causes the spring biased tear bail 77 to rotate toward the tear bar 75, and causes the tear bail end 79 to actuate the tear bail switch contact 57, which in turn actuates the tear sensor 56. As previously discussed herein, the tear sensor 56 provides a signal to the main controller 38 that indicates whether the dispensed portion of sheet product 26 has been separated from the sheet product dispenser 20, and detection via the tear sensor 56 of the sheet product 26 being separated by the tear bar assembly 76 provides a positive feedback to the main controller 38 to energize a de-energized motor 42 when the dispenser 20 is configured to operate in Hang Mode. As discussed above, if the sheet product 26 is prematurely removed during a dispense cycle when the motor 42 is running, the main controller 38 facilitates stopping of the motor 42, waiting a period of time, and then initiating a new dispense cycle.

Figure 11:
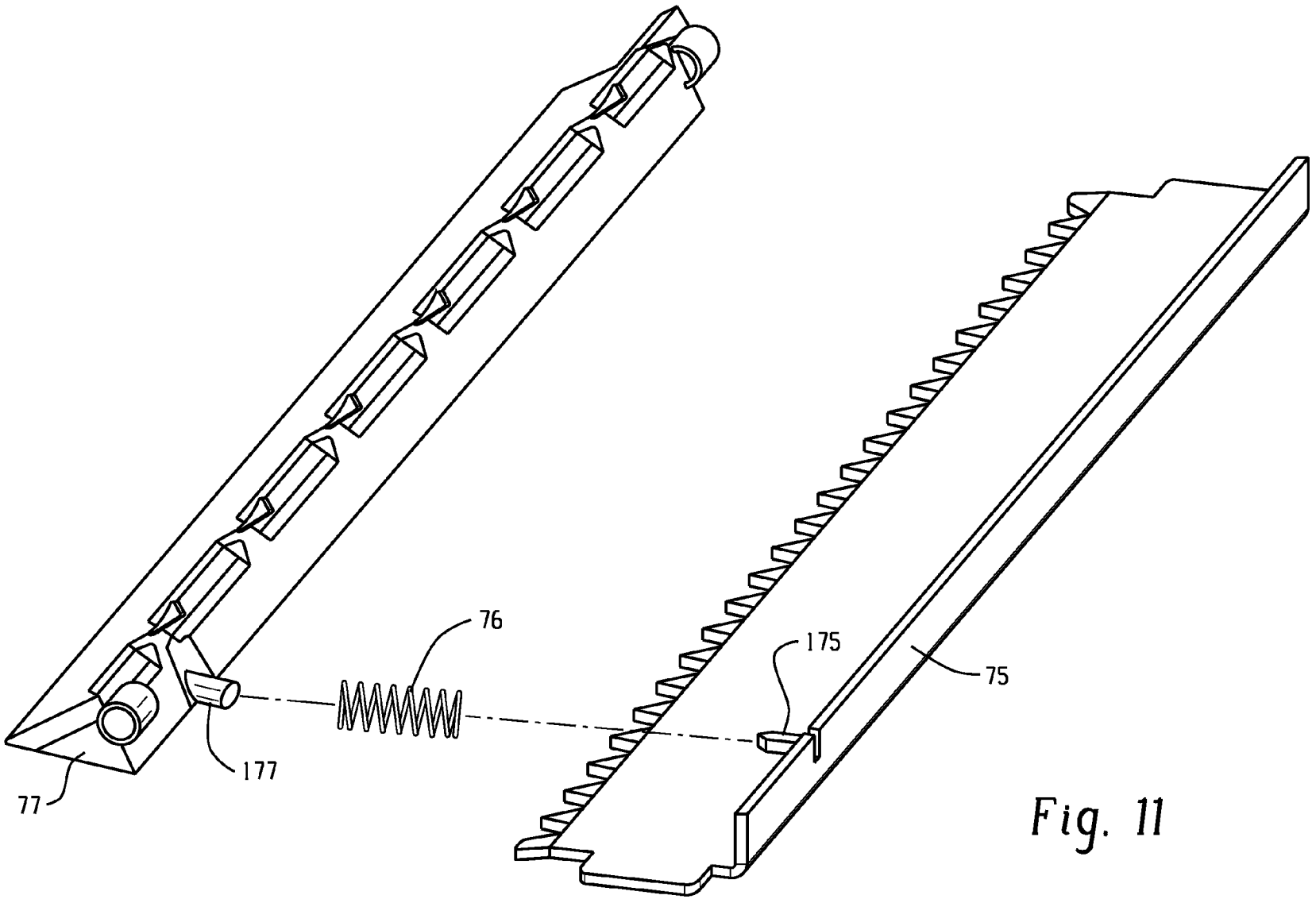
FIG. 11 is an exploded assembly view of the tear bar, tear bail and biasing spring of FIGS. 9 and 10, in accordance with an embodiment of the invention.

With reference now to FIG. 11, an exploded assembly view of the stationary tear bar 75, movable tear bail 77 and spring 76 is shown. In an embodiment, the tear bail 77 is directly connected to the tear bar 75 via the spring 76, where one end of the spring 76 engages with a tab 175 of the tear bar 75, and an opposing end of the spring 77 engages with a tab 177 of the tear bail 77. In an embodiment, the spring 76 is a helical spring where the tabs 175, 177 engage within an inner diameter of the helical coils of the spring 76 at opposing ends thereof. While the embodiment of FIG. 11 depicts a certain type of spring 76, it will be appreciated that other spring arrangements suitable for a purpose disclosed herein and directly coupling the movable tear bail 77 to the stationary tear bar 75 may also be used, such as a torsion spring for example. Accordingly, alternative spring arrangements suitable for a purpose disclosed herein and in accordance with the disclosure herein are contemplated and considered within the scope of the claimed invention.

In an embodiment, the main controller 38 includes executable instructions that interpret a pressing of the push button 200 as an override request to override the tear sensor 56 to signal the main controller 38 to dispense a length of sheet product 26, which may be useful in clearing a paper jam in the dispenser 20 that causes the tear bail 77 to stay in an actuated position, that is, in a position that signals the motor 42 to not run.

In an embodiment, the main controller 38 further includes executable instructions that interpret a signal from the tear sensor 56 in such a manner as to provide a bumping voltage pulse to the motor 42 if the tear sensor 56 moves from the home position to an actuated position but does not return back to the home position, which would provide a motor-stop-signal to the main controller 38, but would not provide a signal indicative of a request to initiate a new dispense cycle, which may be interpreted by the main controller 38 as a paper jam condition. If the bumping of the motor 42 successfully resets the tear sensor 56 to its home position indicating that the paper jam has been cleared, then no further remedial action is taken. If the bumping of the motor 42 does not successfully reset the tear sensor 56 to its home position, then the main controller 38 may perform further remedial action, such as by causing the flashing of an LED 34, such as LED 34*c*, for example.

Figure 12:
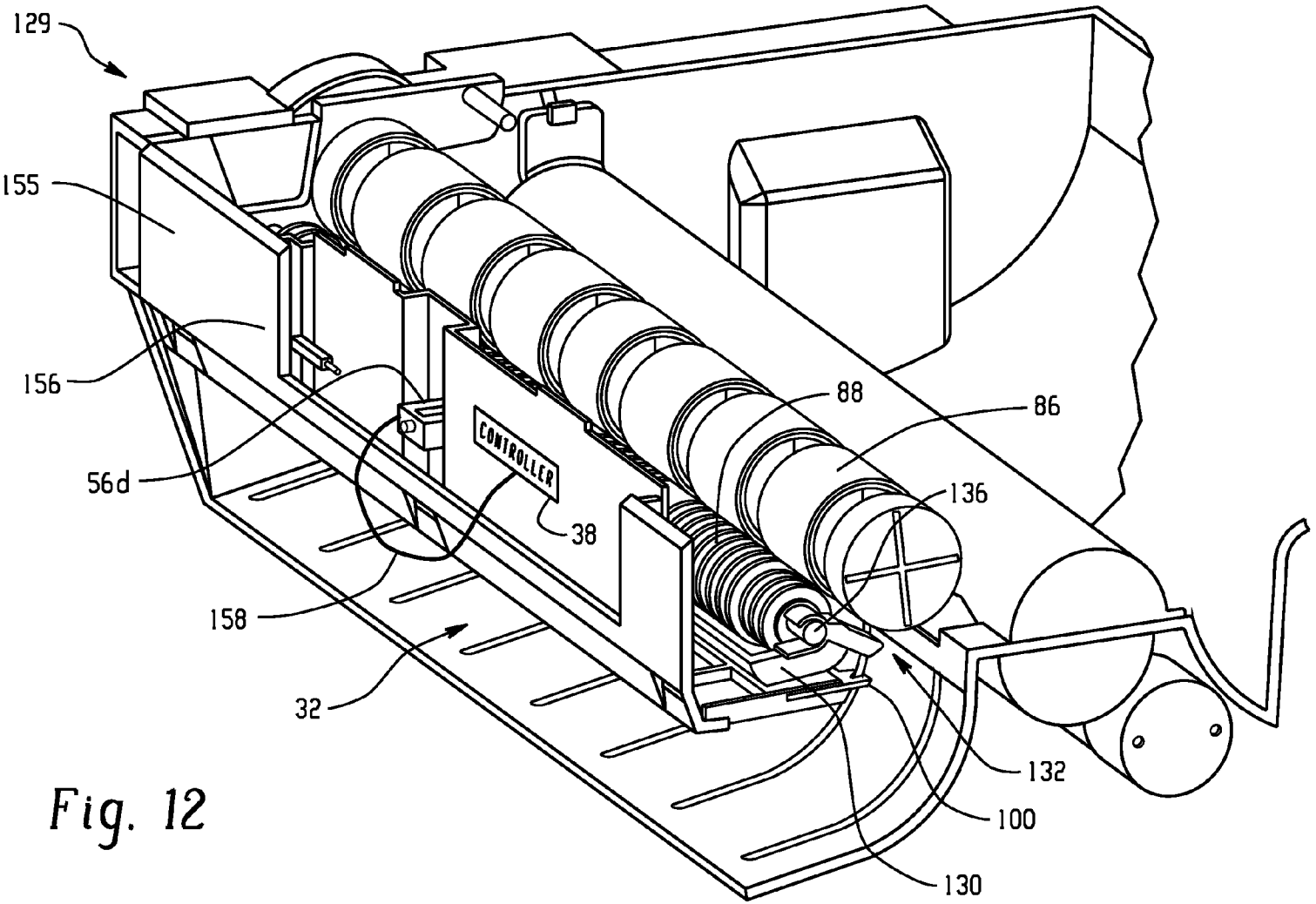
FIG. 12 is a partial perspective view illustration of the sheet product dispenser of FIG. 5 with another alternate embodiment of a tear sensor.
Figure 13:
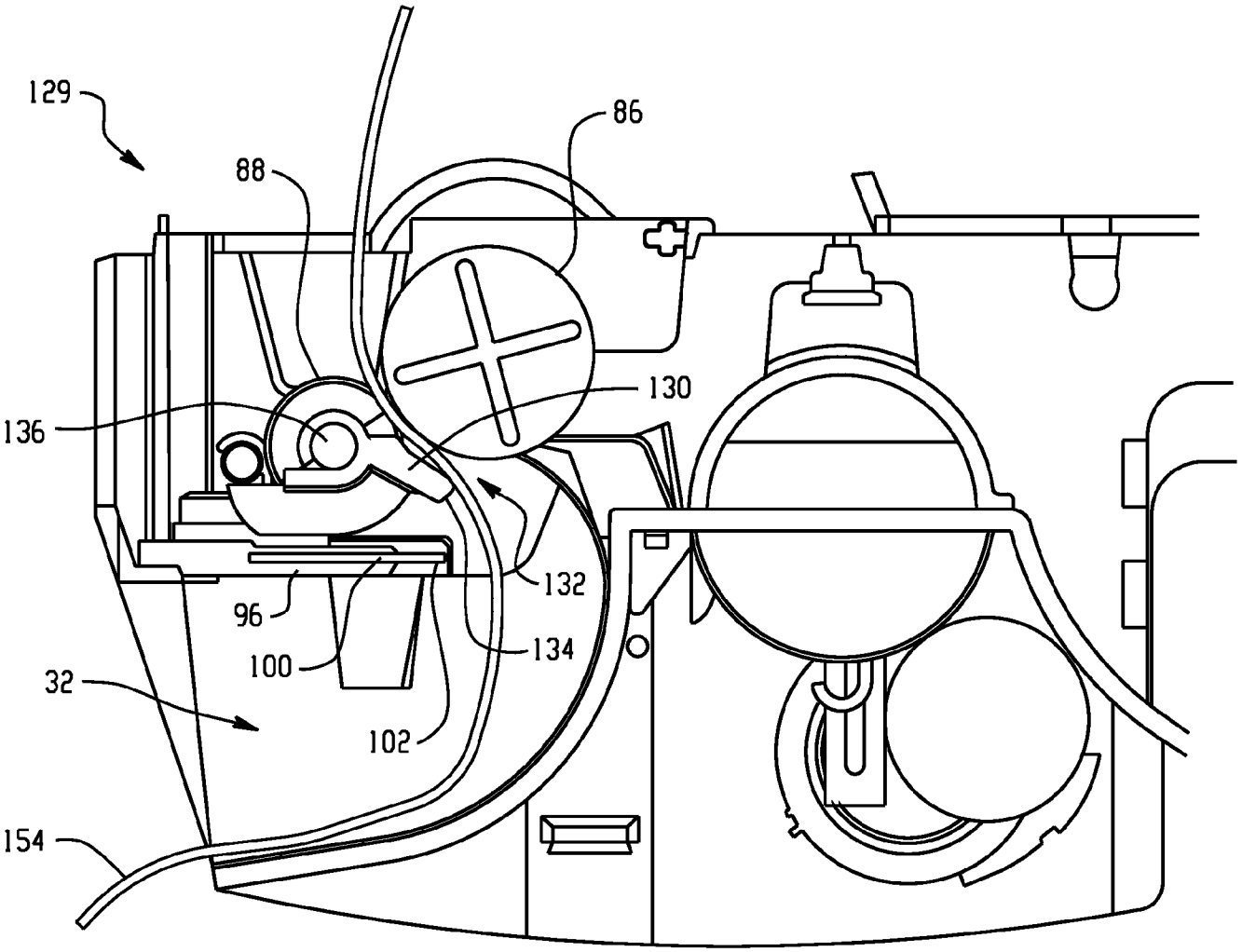
FIG. 13 is a partial side plan view illustration of the sheet product dispenser and tear sensor of FIG. 12.
Figure 14:
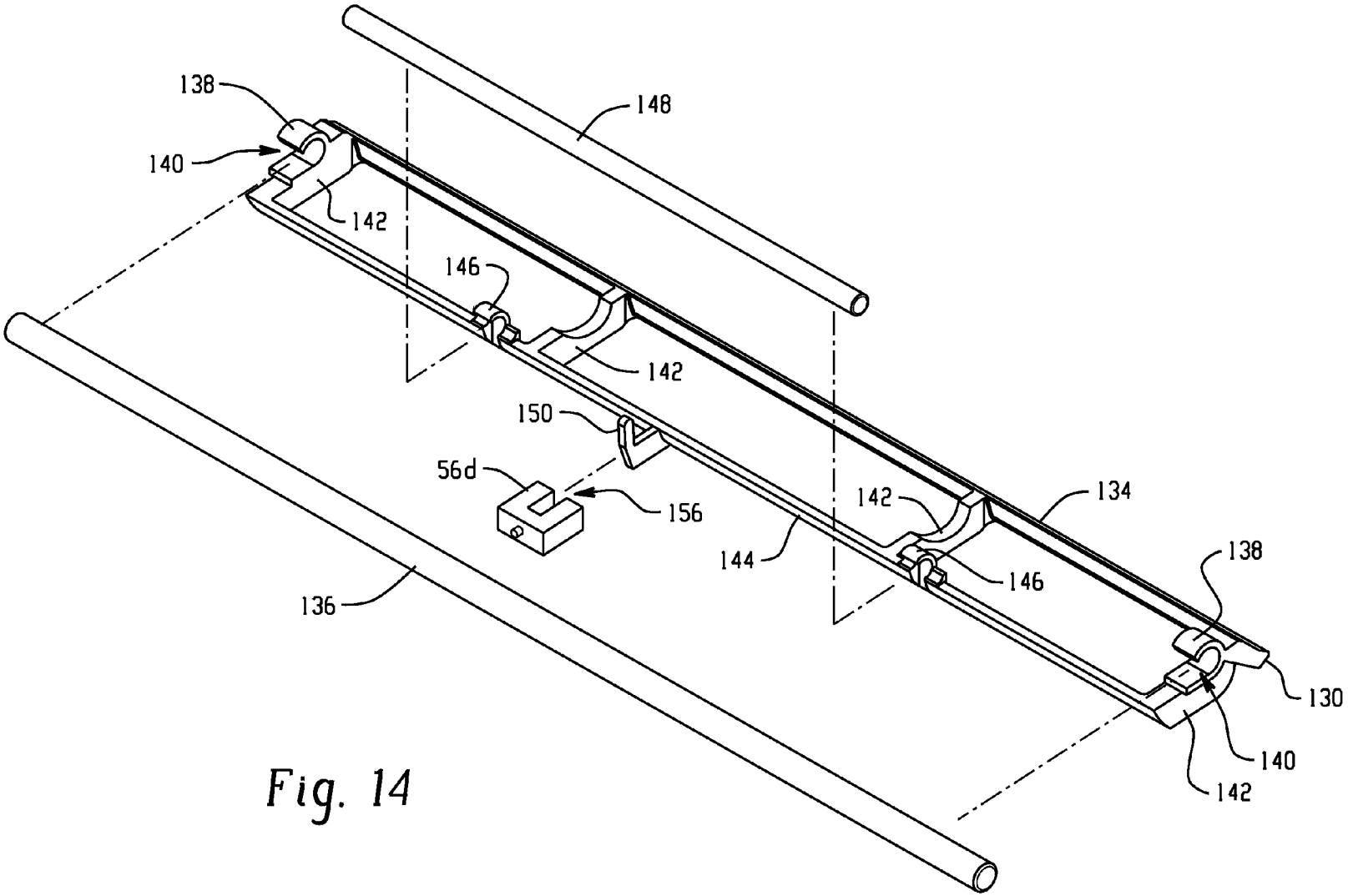
FIG. 14 is a partial exploded view illustration of the tear bail assembly of FIGS. 12 and 13.

Another alternate embodiment sheet product dispenser 129 is illustrated in FIGS. 12-14. In this embodiment, a tear bail 130 is arranged adjacent an opening 132. The tear bail 130 includes a smooth curved portion 134 that is positioned in the path of the sheet product 26. The curved portion 134 extends substantially across the width of the dispensing slot 32. The tear bail 130 is rotatably coupled to a pinch roller shaft 136 by a pair of projections 138 to allow the tear bail 130 to rotate. In the example embodiment, the projections 138 include openings 140 that allow the projections 138 to couple to the pinch roller shaft 136, such as by a snap fit arrangement for example. A plurality of arms 142 extend from the curved portion 134 connecting the curved portion 134 with a body portion 144. The body portion 144 includes a pair of projections 146 that are sized to receive a weight member 148. A sensor projection 150 also extends from the body portion 144. As will be discussed in more detail below, the sensor projection 150 cooperates with an optical sensor 56*d* to generate a signal when the tear bail 130 is moved, such as when sheet product 154 is dispensed.

The tear bail 130 with the weight member 148 attached is arranged such that the center of gravity of the assembly is between the weight member 148 and the pinch roller shaft 136. This biases the tear bail 130 to rotate such that the curved portion 134 moves towards the opening 132. As will be discussed in more detail below, when sheet product 154 is pulled by a user, the tear bail 130 will rotate away from the opening 132. Once the sheet product 154 is dispensed, the tear bail 130 rotates back to the initial position under the bias caused by the mass of weight member 148. It should be appreciated that an elastic member, such as a spring for example, may also generate the above-mentioned biasing force.

Adjacent the tear bail 130, a tear bar 100 is coupled to the housing projection 96. The tear bar edge 102 of the tear bar 100 is positioned adjacent to the opening 98. It should be appreciated that while the tear bar 100 is illustrated as being separate from housing projection 96, the tear bar 100 may alternately be integral with the projection 96.

The optical sensor 56*d* is mounted to the housing 155 and is electrically coupled to the main controller 38. In the exemplary embodiment, the optical sensor 56*d* is generally u-shaped having a slot 156 sized to receive the sensor projection 150. In the embodiment shown in FIGS. 12-14, the optical sensor 56*d* is a self-contained sensor having both an optical transmitter (not shown), such as an LED for example, and an optical receiver (not shown). The transmitter and receiver are arranged such that sensor light from the transmitter is continuously directed and received by the receiver. The optical sensor 56*d* is arranged to generate a signal in response to the interruption of the sensor light such as when the sensor projection 150 is rotated through the slot 156. It should be appreciated that other types of sensors may also be used to detect the motion of the tear bail 130. A microswitch, or a non-integrated optical sensor for example, may determine the rotation of the sensor projection 150.

In an embodiment during a Hang Mode operation, a user activates the sheet product dispenser 129, such as by actuating the tear sensor 56 or the push button 200 as described above. The dispenser 129 then initiates a dispense cycle by rotating the drive roller 86 and the pinch roller 88 causing the sheet product 154 to pass through the opening 132 and out of dispensing slot 32. A user may then pull on the sheet product 154 causing the tear bail 130 to rotate about the pinch roller shaft 136. The rotation of the tear bail 130 causes the sensor projection 150 to move into the slot 156 interrupting the sensor light on the optical sensor 56*d*.

When the sensor projection 150 interrupts the sensor light, the optical sensor 56*d* sends an electrical signal over a conductor 158 to main controller 38. Upon receiving the voltage signal from optical sensor 56*d*, the main controller 38 infers that the sheet product 154 has been separated and that a new dispensing cycle should be initiated.

From the foregoing, it will be appreciated that reference to sensor 56 is in reference to a tear sensor in general, and that reference to sensors 56*a, b, c* or *d* is in reference to a particular type of tear sensor. As such, it is contemplated that other tear sensors not specifically described and illustrated herein but falling within the ambit of the claimed invention are encompassed by reference to tear sensor 56 in general.

From the foregoing it will be appreciated that the auxiliary feed push button 200 when actuated by a user can serve to dispense a first length of sheet product 26 regardless of whether a tear is detected by the tear sensor 56 and communicated to the main controller 38, or not. As such, a user may use the auxiliary feed push button 200 to facilitate dispensing of sheet product 26 when the tear sensor 56 does not successfully communicate a tear signal to the main controller 38, or may use the auxiliary feed push button 200 to facilitate dispensing of a second length of sheet product 26, in addition to the first dispensed length of sheet product 26, to provide dispensed product having additional sheet length. It will be further appreciated that the auxiliary feed push button 200 may also allow a user to request further additional lengths of sheet product 26 without having to first tear off those lengths already dispensed.

While embodiments of the invention have been described and illustrated herein having a cover 22 that covers the sheet product 26 and other internal components of the dispenser 20, it will be appreciated that other configurations of the cover 22 may be used having an exposed chassis arrangement with some internal components of the dispenser 20 exposed, without departing from the scope of the invention disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc. do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sheet product dispenser, comprising:

a housing having a cover;

a main controller, a motor, and a dispensing mechanism all disposed within the housing and in operable communication with each other to dispense a length of sheet product;

an indicator light disposed relative to the housing and configured in operable communication with the main controller to provide indication to a user of a functional aspect of the dispenser;

a stationary tear bar operably disposed proximate the dispensing mechanism to facilitate separation of the sheet product, a movable tear bail operably disposed proximate the tear bar, and a tear sensor operably disposed to send a tear signal to the main controller upon movement of the tear bail, wherein the stationary tear bar, the tear bail, and the tear sensor are operable when the cover is open and when the cover is closed; and an auxiliary feed push button disposed in operable communication with a switch, the switch being internally disposed within the housing so as to be accessible and actuatable by a user when the cover is open to dispense a length of sheet product in response to actuation of the switch by a user when the cover is open, the push button being so disposed as to be accessible and actuatable by a user when the cover is closed and comprising a viewing window configured to allow a user to view the indicator light;

wherein the main controller is responsive to executable instructions to facilitate actuation of the motor and the dispensing mechanism to dispense a length of sheet product in response to the signal from the tear sensor;

wherein the main controller is responsive to executable instructions to facilitate actuation of the motor and the dispensing mechanism to dispense a length of sheet product in response to a signal from the switch when actuated by the auxiliary feed push button; and wherein the main controller is responsive to executable instructions to facilitate actuation of the motor and the dispensing mechanism to dispense a length of sheet product in response to a signal from the switch when the switch is actuated by a user.

2. The sheet product dispenser of claim 1, wherein the main controller is responsive to executable instructions to initiate a new dispense cycle in response to a signal from the tear sensor being indicative of the tear sensor having moved from a home position to an actuated position and back to the home position.

3. The sheet product dispenser of claim 2, wherein the main controller is responsive to executable instructions to facilitate actuation of the motor and the dispensing mechanism in response to actuation of the auxiliary feed push button even if a signal from the tear sensor received by the main controller is not indicative of the tear sensor having changed state from a home position to an actuated position and subsequently having changed state from the actuated position to the home position.

4. The sheet product dispenser of claim 2, wherein the main controller is responsive to executable instructions to facilitate actuation of the motor and the dispensing mechanism in response to actuation of the auxiliary feed push button in an event where the signal from the tear sensor is representative of the tear bail having moved from a home position to an actuated position but is not representative of the tear bail having moved back to the home position.

5. The sheet product dispenser of claim 1, wherein the push button is in snap-fit engagement with the housing.

6. The sheet product dispenser of claim 1, wherein the main controller is further responsive to executable instructions to facilitate actuation of the motor and the dispensing mechanism for a predetermined amount of time if the auxiliary feed push button is depressed and held in a depressed state by a user.

7. The sheet product dispenser of claim 1, further comprising a positive stop relative to the housing, the positive stop being in operable communication with the switch to limit the amount of actuation of the switch when the auxiliary feed push button is fully depressed.

8. The sheet product dispenser of claim 1, wherein the movable tear bail is directly coupled to the stationary tear bar via a spring.

9. The sheet product dispenser of claim 8, wherein the spring is a helical spring, the movable tear bail comprises a first tab disposed in engagement with one end of the helical spring, and the stationary tear bar comprises a second tab disposed in engagement with an opposing end of the helical spring.

10. The sheet product dispenser of claim 1, wherein the indicator light is configured to provide indication of a jam condition.

11. The sheet product dispenser of claim 1, wherein the indicator light is configured to provide indication of a low battery condition, a jam condition, activation of a dispense cycle, or a combination thereof.

12. The sheet product dispenser of claim 1, wherein the indicator light is disposed relative to the housing such that the indicator light is more readily visible through the viewing window when the auxiliary feed push button is depressed by a user.

13. The sheet product dispenser of claim 1, wherein the viewing window is clear and without magnification, such that the indication light is visible through the viewing window when the auxiliary feed push button is depressed or in an unactuated position.

14. The sheet product dispenser of claim 2, wherein the main controller is responsive to executable instructions to provide a bumping voltage pulse to the motor in response to a signal from the tear sensor being indicative of the tear sensor having moved from the home position to the actuated position and not returning back to the home position.

15. The sheet product dispenser of claim 14, wherein the indicator light is configured to provide indication of the tear sensor not returning back to the home position after the bumping voltage pulse is provided to the motor.

16. A sheet product dispenser, comprising:

a housing having a cover with an opening therein;

a main controller, a motor, and a dispensing mechanism all disposed within the housing and in operable communication with each other to dispense a length of sheet product;

a stationary tear bar operably disposed proximate the dispensing mechanism to facilitate separation of the sheet product, a movable tear bail operably disposed proximate the tear bar, and a tear sensor operably disposed to send a tear signal to the main controller upon movement of the tear bail, wherein the stationary tear bar, the tear bail, and the tear sensor are operable when the cover is open and when the cover is closed; and an auxiliary feed push button disposed in operable communication with a switch, the switch being internally disposed within the housing so as to be accessible and actuatable by a user when the cover is open to dispense a length of sheet product in response to actuation of the switch by a user when the cover is open, the push button being so disposed as to be accessible via the opening and actuatable by a user when the cover is closed;

wherein the main controller is responsive to executable instructions to facilitate actuation of the motor and the dispensing mechanism to dispense a length of sheet product in response to the signal from the tear sensor;

wherein the main controller is responsive to executable instructions to facilitate actuation of the motor and the dispensing mechanism to dispense a length of sheet product in response to a signal from the switch when actuated by the auxiliary feed push button;

wherein the main controller is responsive to executable instructions to facilitate actuation of the motor and the dispensing mechanism to dispense a length of sheet product in response to a signal from the switch when the switch is actuated by a user; and wherein the push button comprises a protrusion disposed at a side of the push button opposite the opening when the cover is closed, the protrusion being configured to engage the switch and to restrict movement of the push button through the opening.

17. The sheet product dispenser of claim 16, further comprising a positive stop relative to the housing, the positive stop being in operable communication with the switch to limit an amount of actuation of the switch when the auxiliary feed push button is fully depressed.

18. The sheet product dispenser of claim 16, wherein the push button is in snap-fit engagement with the housing.

19. The sheet product dispenser of claim 16, further comprising a printed circuit board disposed within the housing and comprising a microswitch in operable communication with the switch, the microswitch being configured to send a signal to the main controller in response to actuation of the switch.

20. A sheet product dispenser, comprising:

a housing;

a cover associated with the housing, the cover movable between an open position and a closed position;

a dispensing mechanism disposed within the housing, the dispensing mechanism operable to dispense a sheet product in response to instructions from a main controller;

a tear bar operably disposed proximate the dispensing mechanism to facilitate separation of the sheet product and a tear sensor operable to send a tear signal to the main controller in response to separation of the sheet product from the dispensing mechanism, wherein the tear bar and the tear sensor are operable when the cover is open and when the cover is closed;

a switch disposed within the housing and accessible to a user when the cover is in the open position, the switch operable to send a dispense request signal to the main controller in response to the switch being actuated by the user when the cover is in the open position; and a button associated with the cover and accessible to the user when the cover is in the closed position, the button in operable communication with the switch when the cover is in the closed position, the button operable to cause the switch to send the dispenser request signal to the main controller in response to the button being actuated by the user when the cover is in the closed position;

wherein the main controller is operable to cause the dispensing mechanism to dispense the sheet product in response to receiving the tear signal from the tear sensor;

wherein the main controller is operable to cause the dispensing mechanism to dispense the sheet product in response to receiving the dispense request signal from the switch when the cover is in the open position and the switch is actuated by the user; and wherein the main controller is operable to cause the dispensing mechanism to dispense the sheet product in response to receiving the dispense request signal from the switch when the cover is in the closed position and the switch is actuated via the button.

* * * * *